US007506645B2

(12) United States Patent
Offredi

(10) Patent No.: US 7,506,645 B2
(45) Date of Patent: Mar. 24, 2009

(54) OVEN OR GRILL BURNER, VENTURI TUBE, MOUNTING FOR A THERMOCOUPLE AND/OR AN IGNITER, AND PROCESS FOR FABRICATING SAID BURNER

(75) Inventor: Giorgio Offredi, Galbiate (IT)

(73) Assignee: Castifutura S.p.A., Milan (IT)

( * ) Notice: Subject to any disclaimer, the term of this patent is extended or adjusted under 35 U.S.C. 154(b) by 409 days.

(21) Appl. No.: 10/509,634

(22) PCT Filed: Apr. 8, 2003

(86) PCT No.: PCT/EP03/50095

§ 371 (c)(1),
(2), (4) Date: Feb. 7, 2005

(87) PCT Pub. No.: WO2004/005799

PCT Pub. Date: Jan. 15, 2004

(65) Prior Publication Data

US 2005/0138789 A1 Jun. 30, 2005

(30) Foreign Application Priority Data

Apr. 19, 2002 (IT) ..... SV2002A0015

(51) Int. Cl.
*F24C 3/00* (2006.01)
*F23D 14/62* (2006.01)

(52) U.S. Cl. ..... 126/91 A; 126/39 E; 126/41 R; 431/354

(58) Field of Classification Search ..... 29/890.02; 431/39 E, 41 R, 91 R, 91 A, 354; 126/39 E, 126/41 R, 91 R, 91 A
See application file for complete search history.

(56) References Cited

U.S. PATENT DOCUMENTS

| | | | | |
|---|---|---|---|---|
| 3,156,292 | A | 11/1964 | Ross | |
| 3,540,258 | A * | 11/1970 | Branson | 72/324 |
| 4,416,249 | A * | 11/1983 | Reynolds et al. | 126/41 R |
| 4,418,456 | A | 12/1983 | Riehl | |
| 5,186,620 | A * | 2/1993 | Hollingshead | 431/354 |
| 5,406,703 | A * | 4/1995 | Haen et al. | 29/890.02 |
| 6,244,263 | B1 * | 6/2001 | Schlosser et al. | 126/36 R |

FOREIGN PATENT DOCUMENTS

| | | |
|---|---|---|
| EP | 0 844 435 A | 5/1998 |
| FR | 1 577 719 A | 8/1969 |

* cited by examiner

*Primary Examiner*—Steven B McAllister
*Assistant Examiner*—Sarah Suereth
(74) *Attorney, Agent, or Firm*—Themis Law

(57) ABSTRACT

The invention relates to a burner comprising two half shells, one of which is perforated, that are tightly joined together along at least a portion of their edges, so as to form a tubular body communicating with a venturi tube. At least two corresponding ends of the two half shells have a truncated profile, providing the tubular body has at least one truncated end. The invention also relates to a venturi tube for said burner that is composed of two half shells The invention further relates to a mounting for a thermocouple and for an igniter of said burner, the mounting having coupling means that cause mutual contact surfaces to be oriented in at least three non-parallel planes and that prevent mounting rotation, so that the position thereof is accurately defined. The invention also relates to a process for fabricating said burner.

24 Claims, 29 Drawing Sheets

OVEN OR GRILL BURNER, VENTURI TUBE, MOUNTING FOR A THERMOCOUPLE AND/OR AN IGNITER, AND PROCESS FOR FABRICATING SAID BURNER

CROSS-REFERENCE TO RELATED APPLICATION

The present patent application is the national stage of international application no. PCT/EP2003/050095 having an international filing date of Apr. 8, 2003 and claiming priority to Italian patent application SV2002A000015 filed on Apr. 19, 2002.

REFERENCE TO A COMPUTER LISTING, A TABLE, OR A COMPUTER PROGRAM LISTING COMPACT DISK APPENDIX

Not applicable.

BACKGROUND OF THE INVENTION

1. Field of the Invention

The invention relates to an oven or grill burner, i.e. a burner that can be used either for an oven or a grill, which is composed of two half shells, one whereof is perforated, which are tightly joined together along at least a portion of their edges, so as to form a tubular body communicating with a venturi tube, in which fuel gas and combustion air are mixed.

2. Description of Related Art

At present, two types of oven or grill burners exist: tubular burners and flat burners. Each of them has specific construction features, which provide a number of advantages and drawbacks, as briefly described below.

Tubular burners substantially consist of a tubular section, which has a closing member at an end, typically a plate that is shaped in such a manner as to also act as a burner fastening base. At the opposite end the tubular body is shaped, typically by a drawing process, to form a funnel-shaped, tapering section, which forms the venturi tube. A pilot burner is fitted, generally by welding, in a longitudinal lower section of the tubular body, with respect to the burner mounted condition, which pilot consists of a sheet metal half shell, at an appropriate distance from the tubular body. A parabolic reflector, which is designed to convey the flame, is fitted in a longitudinal section, which is diametrically opposite to the pilot burner attachment portion, typically by spot welding, above the tubular body.

Tubular burners have considerable construction advantages, particularly associated to the fact that they have a truncated end, which is designed to be closed by the above mentioned member. Due to this feature, burners of different lengths may be provided by cutting to length a single type of tube, or a reduced number of tube types, with no need to have in stock a plurality of parts with predetermined lengths, designed for the different uses. Furthermore, tubular burners have a particularly constant operation, regardless of the gas in use. For all these reasons tubular burners are the best suited to cover a wide market range.

Nevertheless, they also have considerable drawbacks, mainly the fact that gas outlet holes cannot have a diameter below a certain size, generally corresponding to the thickness of the wall of the tubular body, which cannot be too thin, for structural strength reasons, and for this reason the flame, and hence heat, may not be distributed in an optimized manner. Furthermore, leakage may occur from the closing member. Other problems are associated to the high cost of steel, the tubular body being generally made of this material. It shall also be considered that steel tubes are not made by extrusion but by bending a metal sheet, and so they have a longitudinal welding line, whose orientation shall be accounted for when the pilot burner and the parabolic reflector are secured. The longitudinal welding may open during the drawing process, aimed at tapering the end in which the venturi tube is provided, or said opening may occur later, during use, due to thermal shocks, with a serious damage to the manufacturer's image. Moreover, when an end of the tubular body is bent, as required if the venturi tube is to be positioned transversely, to obtain a longer tubular body (with respect to the available space inside the oven), this may cause internal stresses, which may cause the opening of the welding line. Also, fastening and sealing problems may be also generated if a member is to be fastened on the tubular body by means of screws. The ignition electrode and/or the flame safeguard are generally supported by a plate that is generally fitted between the parabolic reflector and the tubular body and whose position is very critical as the electrode and the thermocouple must be situated in a predetermined, accurate position with respect to the gas outlet holes, to prevent any ignition and/or flame detection problem. The pilot burner must be positioned in a very accurate position with respect to a row of holes formed on the tubular body, which are designed to supply gas thereto, and pilots of different lengths must be kept in stock to fit the length of the finished burner. Moreover, it has spacer feet which extend all along its length and adhere against the outer wall of the tubular wall and whose wrong positioning may cause the pilot burner holes and/or the gas outlet holes to be obstructed. Moreover, cracks may be caused by the presence of the welding, as mentioned above, by a change in the material quality and by a degraded ductility of the material in stock. For all those reasons, the fabrication of tubular burners is relatively expensive.

Flat burners are composed of two half shells and have the advantageous characteristic of having an integrated pilot burner, which is made of one piece therewith by bending the peripheral edges when the two half shells are joined. Therefore, any drawback associated to proper positioning is obviated. The main gas outlet holes and the holes for supplying gas to the pilot burner are obtained by perforation of one of the two half shells. In another type of flat burner, each half shell has a corrugated edge opposite to that of its respective opposite half shell and the gas/air mixture outlet holes are generated by coupling those edges. Although in this second case the perforation step is avoided, the holes still have a rather large size, which is further subjected to changes in the heating step, and sealing problems may also occur between the two half shells. Flat burners typically have advantages that cannot be found in tubular burners, which consist in that all connections, and particularly those for the flame safeguard and the igniter, are prearranged in an optimized manner, and there is no need to position them. Also, unlike tubular burners, flat burners may have inner walls for modulating gas distribution among the various holes, and the lack of these walls might cause unevenness problems, especially at low flame levels. Obviously, flat burners do not have the problem of the end-side closing member.

Despite of all these advantageous characteristics, flat burners provide no advantage in terms of modularity and size adaptability, particularly in length, with respect to different situations and/or oven sizes, whereby a dedicated burner must be manufactured for each cooker type, with a serious impact on costs.

Therefore, this invention has the object of obviating, by simple and inexpensive means, all the above drawbacks, and to provide a burner that has equal or better features than prior art burners. Particularly, a burner is desired that has all the advantages of a flat burner, particularly the integrated pilot burner and well secured igniter and flame safeguard, while maintaining all the construction adaptability and modularity characteristics of the tubular burner, particularly provided by the truncated end thereof, and that always ensures optimized operation in any circumstance, while limiting adaptation to the replacement of the nozzle and possibly to the adjustment of the gas/air stoichiometric ratio. Such a burner would allow the manufacturer to keep a limited number of parts in stock to manufacture burners.

BRIEF SUMMARY OF THE INVENTION

The invention achieves the above purposes by means of a burner like the one described hereinbefore, in which some advantageous construction characteristics of flat burners are integrated with the constriction characteristics of tubular burners, and particularly in which at least two corresponding ends of the two half shells have a truncated profile, in such a manner that this tubular body has at least one truncated end.

As explained in detail in the description of the drawings, the above guiding principle of this invention is applied advantageously to a plurality of embodiments whose characteristics are accurately described in the dependent claims.

In a first embodiment, the tubular body formed by the two half shells has an integrated flame arc forming head at one end, whereas the opposite end is truncated and is closed by pressing together the two half shells. The versatility of this type of burner is provided by the possibility of displacing in length the shell half cutting line to obtain burners of different lengths. The venturi tube is secured in an offline position on one face of the lower half shell near the integrated flame spreader. The upper half shell has at least two bolts which allow proper fastening both of the parabolic reflector and of a mounting for the thermocouple and/or the igniter.

In a second embodiment, the venturi tube is advantageously on the same axis as the tubular body of the burner, which is truncated at the opposite end, which arrangement provides the length adaptability advantages as described above. The truncated end is closed by a separate element, which also acts as a flame spreader. In this case, the parabolic reflector is secured with the above described method, whereas the mounting for the igniter and/or the thermocouple is elastically fitted on a perforated tab provided on one side of the venturi tube.

In a third embodiment, the tubular body is truncated and both ends, one of which is closed by an applied member, particularly having the function of a flame spreader, whereas the separate venturi tube is fastened to the opposite end, directly or with the interposition of a tubular joint.

The advantages of this invention are an improved gas flow, the possibility to operate the burner at a lower minimum running state than normally available thanks to the possibility of forming smaller perforation diameters, a better flame stability at the holes near the thermocouple, safer positioning of the thermocouple and the igniter, with the advantageous possibility of reducing testing and inspection costs, and a wider flame distribution, as compared with tubular burners. The latter characteristic is particularly advantageous when the burner is used as a grill heating source, as it allows food to be more homogeneously cooked. Further advantages are the possibility of perforating smaller sections, though with an overall wider section, while obtaining improvements in terms of flashback and release, the independency from the cost of the steel tube, a smaller number of components in stock, the avoidance of any quality problem associated to a separately manufactured pilot burner, a simpler design of burners, that shall not account for the problem associated to pilot positioning, and the possibility (in certain embodiments) of removing the venturi tube connection curve.

The invention also relates to a venturi tube for an oven or grill burner, comprising a tubular body which has at least one funnel-shaped section which tapers toward a gas/air mixture supplying nozzle, which section has, in a substantially intermediate portion, at least an aperture for the intake of the primary combustion air, and further comprises a tubular sleeve that can slide in the direction of the axis of the venturi tube between a position in which the intake aperture is substantially completely closed and a position in which it is substantially completely open, to adjust the stoichiometric gas/air ratio, said sleeve being provided with position locking means.

The object of the invention is to manufacture, by simple and inexpensive means, a venturi tube which has a great functional and construction adaptability to the various embodiments of the burner as described above, by using most of the construction arrangements used to implement them.

The invention achieves the above objects by providing a venturi tube as described hereinbefore, consisting of two half shells.

As is explained in detail in the description of the drawings, the above described guiding principle is advantageously applied to a plurality of embodiments whose characteristics are accurately described in the dependent claims.

In a first embodiment, the venturi tube is provided separately from the tubular body, and is fitted thereon by means of a tubular sleeve provided on the face of the upper half shell which is introduced and fastened inside a hole which is provided at an end of the lower half shell face.

In a second embodiment, the two half shells of the venturi tube are integrated each with one of the two half shells which form the tubular body of the burner, whereby the venturi tube is formed at the same time as said tubular body by joining the two half shells together. In this case, the venturi tube is advantageously on the same axis as the tubular body of the burner and has a side tab whereon a mounting for an igniter and/or thermocouple may be secured.

In a third embodiment, the venturi tube is still made of two half shells, but it has a truncated end, which is connected to the tubular body of the burner, either directly or through an interposed tubular joint.

The invention further relates to a mounting for supporting in a predetermined position a flame safeguard and/or a burner igniter, which includes means for coupling it to the burner body and/or to the body of the venturi tube.

The object of the invention is allow the provision, by simple and inexpensive means, of a venturi tube which has a great functional and construction adaptability to the various embodiments of the burner and of the venturi tube as described above, while obviating all the problems associated to the difficult igniter and thermocouple positioning, as mentioned before.

The invention achieves the above purposes thanks to a mounting as described hereinbefore, in which the means for connection to the tubular body of the burner and/or to the venturi tube are such that the mutual contact and/or engagement surfaces are oriented in at least three non-parallel planes and include such means for preventing the mounting rotation, so that the position of the mounting is accurately and uniquely defined.

The above guiding principle is advantageously used in two embodiments of the mounting, whose characteristics are better defined in the relevant claims.

In accordance with a first embodiment, the mounting has, at one of its ends, a hole for fastening it above the parabolic reflector of the burner and on one of the fastening bolts thereof and a staple for preventing rotation thereof. At the opposite end, the mounting has a U-shaped arm, having a pair of holes for effectively retaining the igniter and the thermocouple respectively.

In a second embodiment of the mounting, the U-shaped arm has an extension plate which is in turn provided with means for elastic fit in a side tab of the venturi tube.

The invention further relates to the processes for fabricating the various embodiments of the oven or grill burner as described above.

Referring to the above mentioned first embodiment, the latter may include the steps of:

- Forming an upper and a lower half shells by cutting a metal sheet and by bending, drawing and trimming its edges;
- Making a hole at an end of a face of the lower half shell;
- Fitting the lower half shell onto the venturi tube, by inserting the sleeve of the venturi tube in the hole and by pressing the sleeve around the edge of the hole;
- Forming gas/air mixture outlet holes on the two half shells;
- Crimping the two half shells to form the burner body while forming the pilot burner;
- Welding the parabolic reflector fastening bolts on the upper half shell;
- Closing an end of the burner body by pressing together the free and truncated ends of the two half shells;
- Deforming said flattened end to create a burner fastening base;
- Positioning the parabolic reflector on the upper half shell;
- Positioning the mounting for the igniter and/or thermocouple on the upper half shell;
- Securing the parabolic reflector and the mounting;

The above disclosure clearly shows that the burner manufacturing process provides advantageous procedure simplification characteristics, while allowing the production of burners with the above described versatility and adaptability characteristics. Obviously, the steps of the process change at least partly, depending on the type of embodiment, and the claims of the process describe the various construction methods in relation to the various embodiments.

Further characteristics and improvements will form the subject of the dependent claims.

The characteristics of the invention and the advantages derived therefrom will be more apparent from the following detailed description of the annexed drawings.

DETAILED DESCRIPTION OF THE INVENTION

Figure 1:
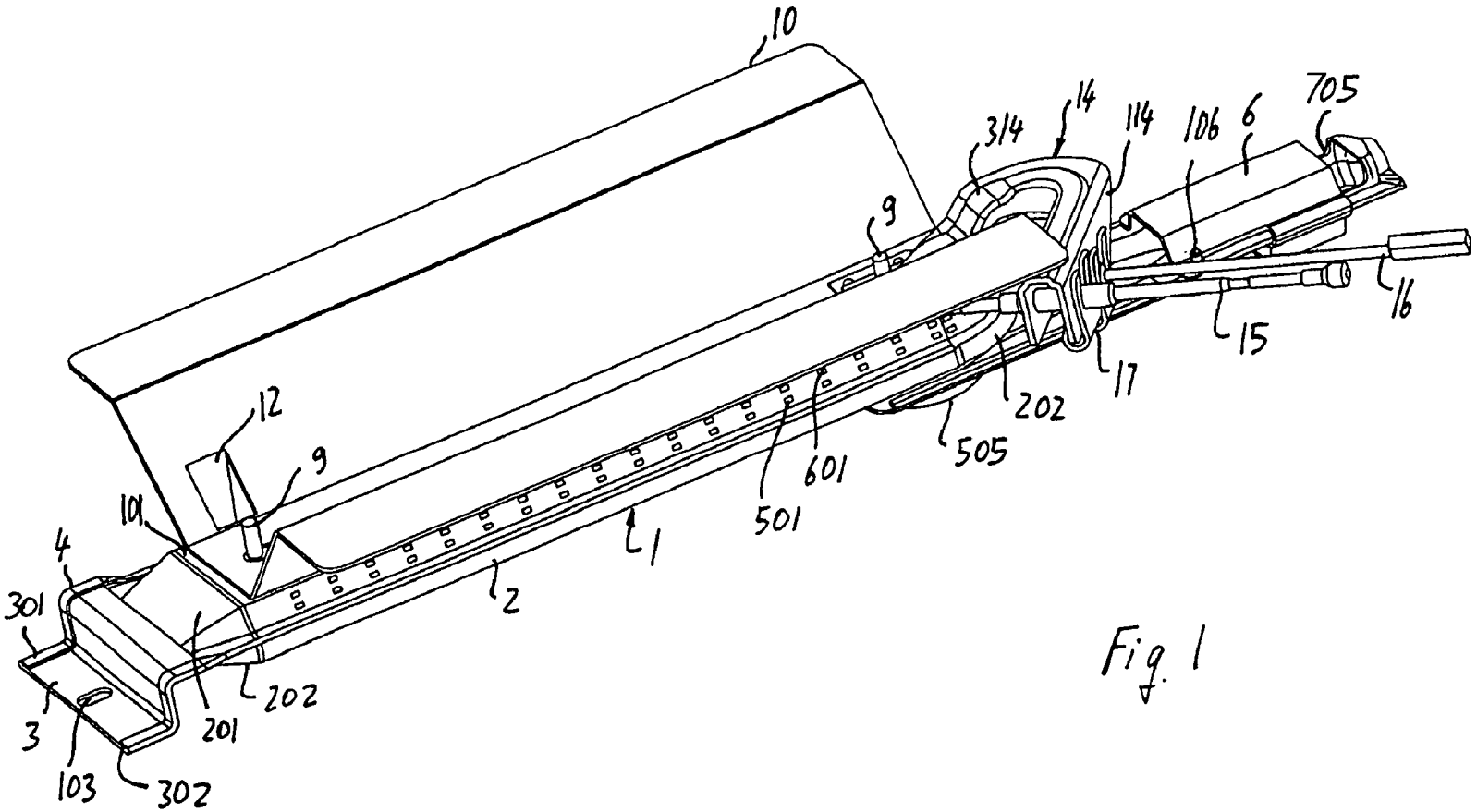
FIG. 1 is a perspective view of a first embodiment of the burner according to the invention.
Figure 2:
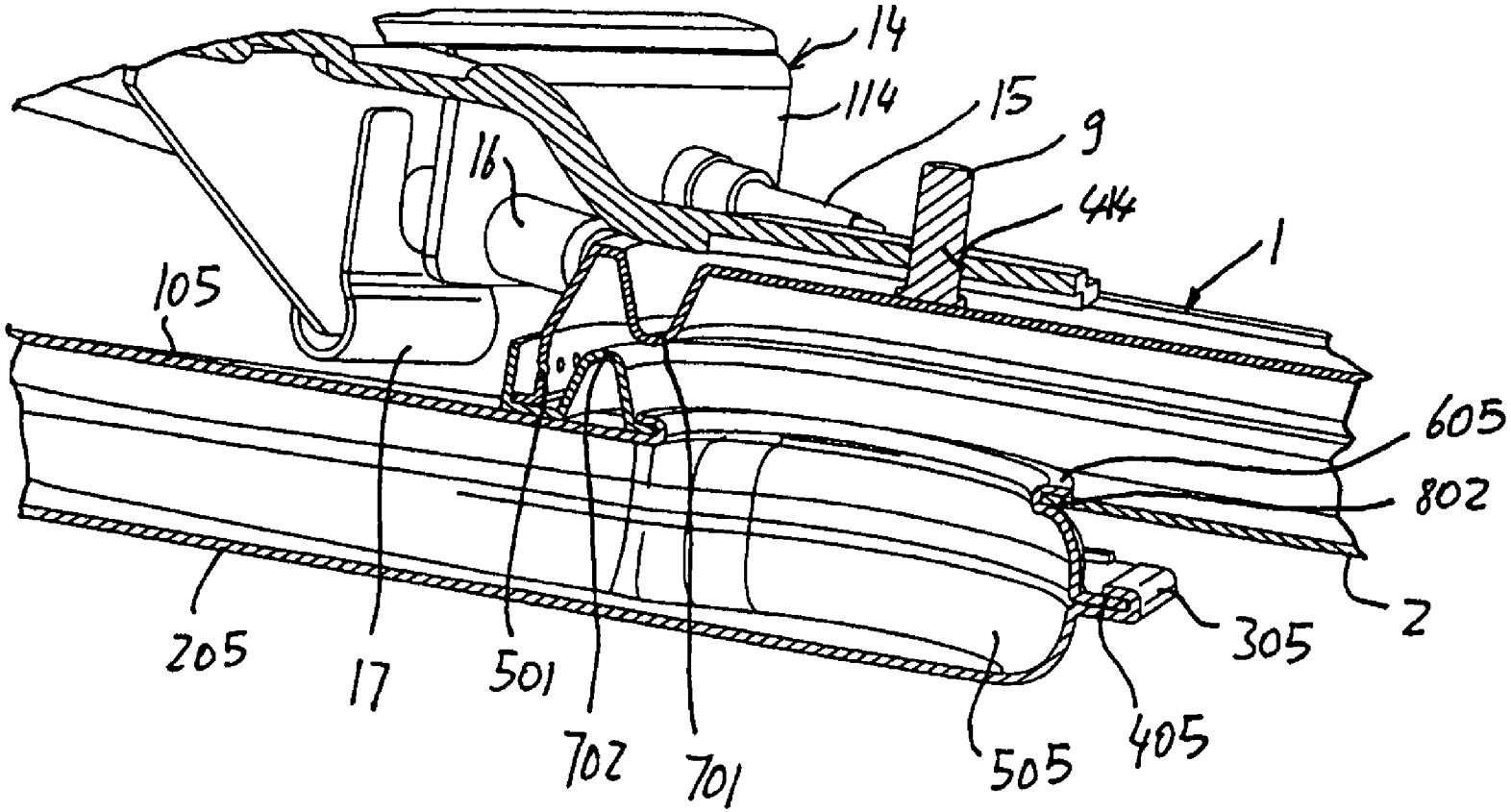
FIG. 2 is a perspective and partly longitudinal sectional view of the venturi tube connection area and of the igniter and thermocouple mounting connection area, with reference to the embodiment as shown in FIG. 1.
Figure 3:
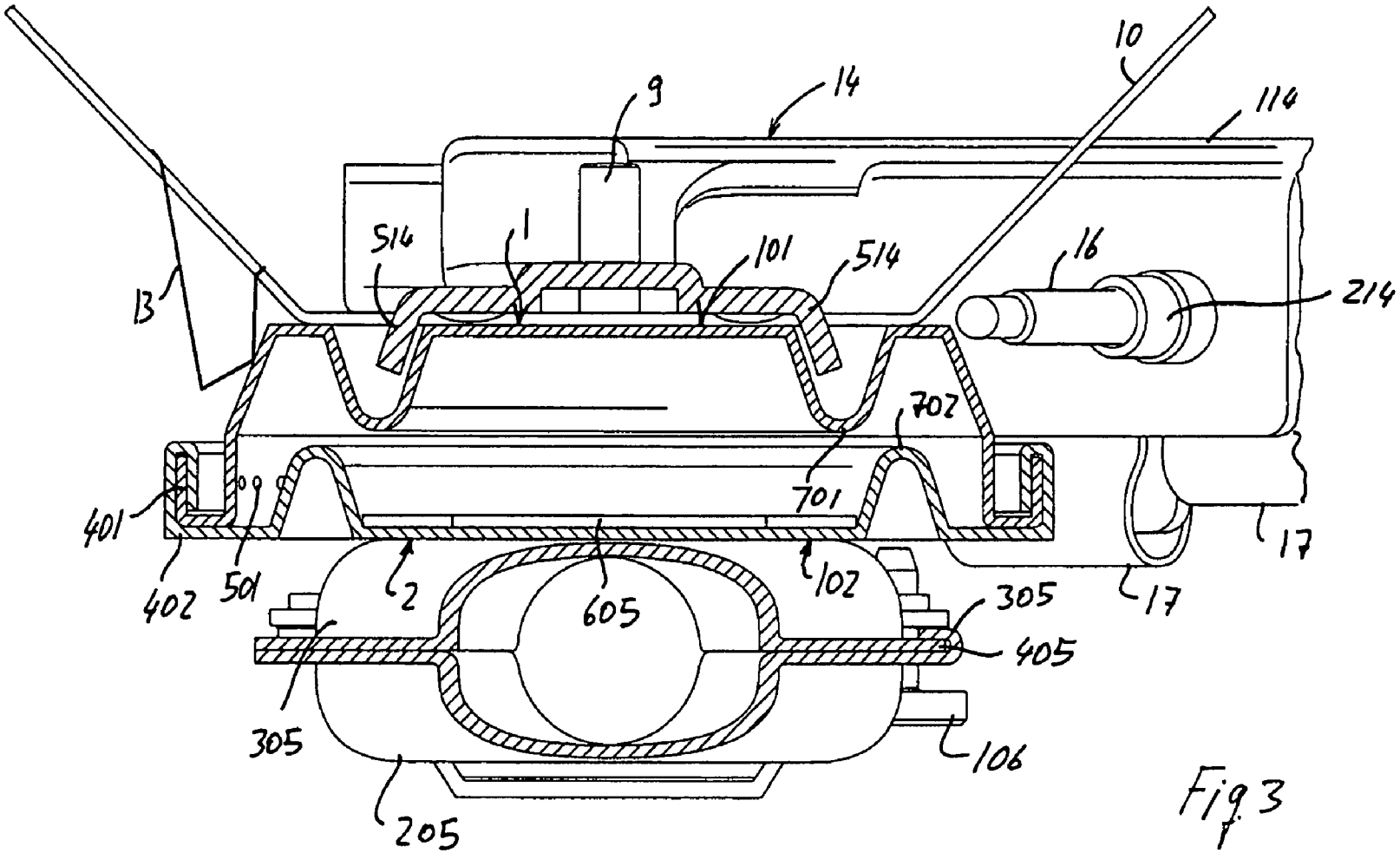
FIG. 3 is a cross sectional view of the burner as shown in FIG. 1.
Figure 4:
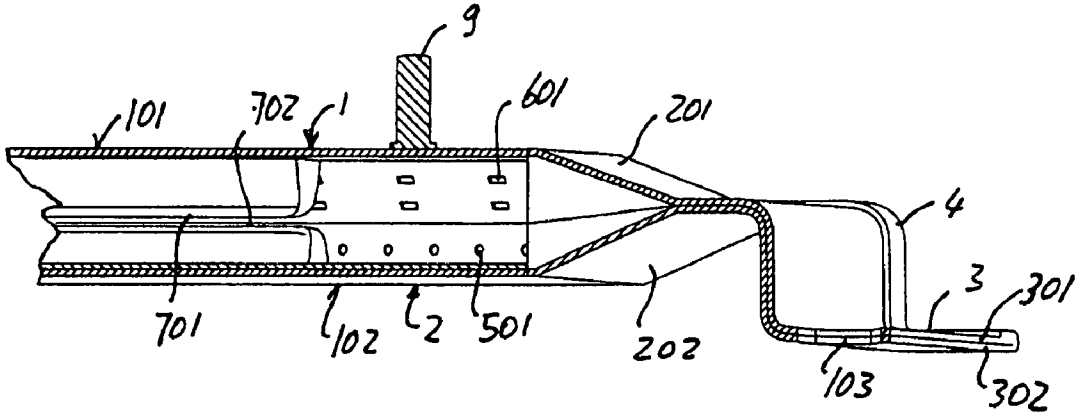
FIG. 4 is a perspective and partly longitudinal sectional view of the truncated end of the burner as shown in FIG. 1.
Figure 8:
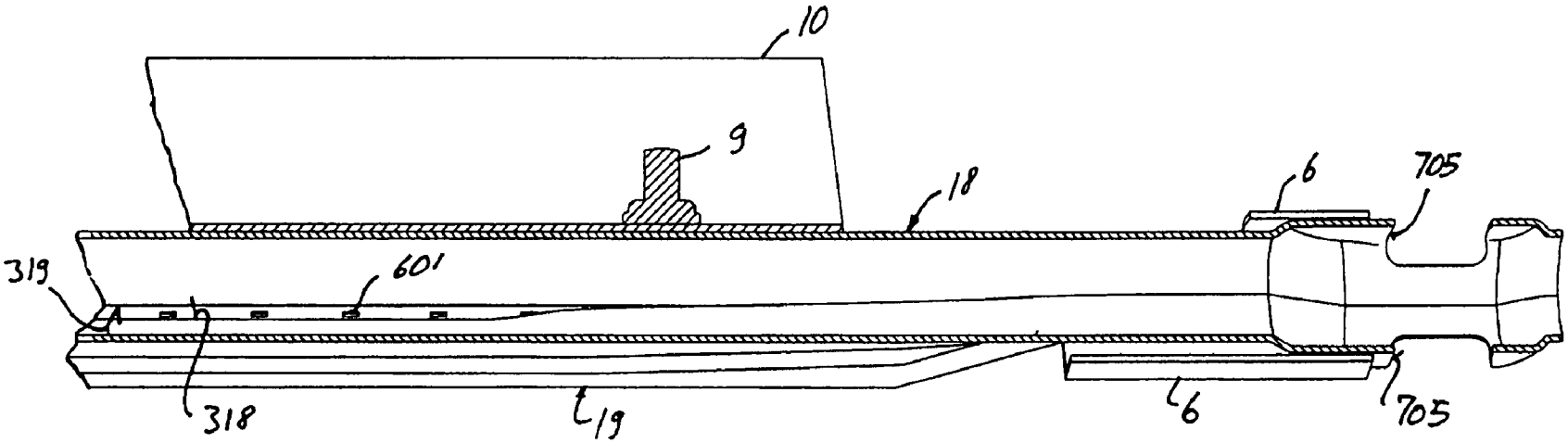
FIG. 8 is a longitudinal sectional view of the venturi tube and of the area in which it is connected to the tubular body of the burner of FIG. 5.

Referring to FIGS. 1 to 4, a first embodiment of a burner according to this invention first includes a pair of half shells, an upper half shell 1 and a lower half shell 2. In this regard, it shall be noted that the words upper and lower are used herein in relation to a burner fitted inside the oven on the bottom wall or immediately beneath the top wall (grill or broiler). The two half shells 1, 2 are elongated and respectively have an upper face 101 and a lower face 102 that are substantially flat and form, in the coupled condition, a tubular body which also has an elongated but substantially flat shape, and integrates, even in the exterior aspect, the two typical characteristics of tubular and flat burners respectively. Two corresponding ends 201, 202 of the upper half shell 1 and of the lower half shell 2 are conformed in such a manner that, when the two half shells 1, 2 are joined together, they automatically form a flame arc forming head. The opposite corresponding ends 301, 302 of the shells 1, 2 are truncated and are conformed in such a manner as to form the closing headpiece of the tubular burner body. The junction plane between the two half shells 1, 2 is substantially parallel both to the bottom and/or the top of the oven and to the outer faces 101, 102 of the two half shells 1, 2, the latter being therefore parallel. The two half shells 1, 2 are tightly joined together by bending continuous peripheral flanges 401, 402, and by further riveting or drawing the latter to form a channel (see FIG. 3) whose outer side wall is opposite to the side wall of the upper half shell 1, which side wall has a row of aligned holes 501 for supplying the gas/air mixture to the channel that forms the pilot burner. Therefore, the pilot burner is made of one piece with the burner body, whereby there is no need to provide a separate part to be attached to the tubular body, with all problems associated thereto. The pilot burner and the row of holes 501 have a substantially U-shaped extension, whose arched portion extends along the flame arc forming head and whose stems end substantially at the truncated ends 301, 302 of the two half shells. Each side wall of the upper half shell 1 has an additional row of larger holes 601, which are not present at the flame arc forming head and form the main gas/air mixture outlet holes. With particular reference to FIGS. 1 and 4, the two truncated ends 301, 302 of the two half shells 1, 2 are pressed together to form a flattened end section, which tightly closes the truncated end of the tubular body. By this arrangement, different lengths of tubular bodies and burners may be obtained by simply cutting the two half shells 1, 2 to the desired length, and by pressing together the truncated ends 301, 302 without applying closing elements thereto, like in prior art tubular burners. This flattened end section has a certain length extension and is later deformed to form a base 3 with a hole 103 in it, to allow the burner to be fastened to the bottom or top wall of the oven. It shall be noted that the two side flanges 401, 402 of the two half shells are further riveted to ensure that the end side edges are closed in a perfectly tight manner. It shall be noted that when the end section is deformed, a plurality of transverse folds 4 are generated to stiffen and seal the truncated end of the tubular body. Each of the two half shells 1, 2 has a substantially U shaped groove at the peripheral edge of the upper face 101 and lower face 102, which groove corresponds to an inner U-shaped continuous recess 701, 702 of each of the two half shells 1, 2 respectively, whose arched section coincides with the arc flame forming head. As is apparent from FIG. 4, the stems of each U-shaped recess 701, 702 end at a predetermined distance from the flattened and deformed end of the tubular body. These two U-shaped recesses 701, 702 extend in staggered positions and the sum of the heights of said two recesses 701, 702 is lower than the distance between the two inner faces of the two half shells 1, 2, in such a manner as to form a continuous slot for the passage of the gas/air mixture in the direction transverse to the flow direction, as shown by the arrow in FIG. 1. The two recesses 701, 702 also act as gas/air mixture conveying walls ensuring an even distribution of the mixture inside the burner body and to the outlet holes 501, 601. In practice, this creates a central preferential passage for the gas/air mixture, whereby the holes at the flattened end of the tubular body are supplied with said mixture at a higher pressure than all other holes that are at a shorter distance from the gas/air mixture inlet port 802, so as to obtain a substantially even output through the holes 501, 601. For this purpose, a circular opening 802 is provided on the outer face 102 of the lower half shell 2, near the flame arc forming head, an end of the venturi tube being sealed thereto, as is apparent from the Figures, in an offline position with respect to the longitudinal axis of the burner body or to the mixture propagation axis. In the embodiment that is shown in the Figures, the median longitudinal axis of the venturi tube is on the same plane as the median longitudinal axis of the tubular body with respect to a plane perpendicular to the junction plane between the two half shells 1, 2, however the venturi tube may be arranged to be oriented transverse to the tubular body to reduce the longitudinal size of the burner and to increase the length of the portion in which the flame is generated. In terms of construction, the circular shape of the air inlet port obviously provides an advantage. The venturi tube is itself formed by two half shells, an upper half shell 105 and a lower half shell 205, which are sealed together along their peripheral edges by bending and riveting peripheral flanges 305, 405. The junction plane between the two half shells 105, 205 is substantially parallel to the junction plane between the two half shells 1, 2. At one end of the venturi tube, there is a chamber 505 whereat the upper half shell 105 has a circular opening with a union 605 that can be tightly fitted into the opening 802 of the lower half shell 2. The sealing effect is obtained by mechanical deformation, i.e. by flanging/riveting the union 605 on the peripheral edge wall of the opening 802, before joining together the two half shells 1, 2 of the burner body. The tubular body of the venturi tube, composed of the two half shells 105, 205, has a substantially funnel-like shape, tapering in a direction opposite to the gas/air mixture inflow, and has a pair of primary combustion air intake apertures 705. The venturi tube further has a tubular sleeve 6 which can slide axially along the venturi tube from a position in which it substantially completely closes said intake apertures 705 to a position in which it substantially completely opens them, thereby providing adjustment of the stoichiometric gas/air ratio. This sleeve 6 has a screw 106 for axially locking it in the proper position. This screw 106 is tightened, through a slot 7 of a side tab of the venturi tube, in a threaded hole 8 of a side tab of the sleeve 6, to lock the latter in the proper axial position. It shall be noted that the venturi tube has another tab, in a diametrically opposite position, which has a slot 7', identical to the slot 7 and disposed symmetrically with respect to it, so that the sleeve 6 may be disposed in an upside-down position with respect to the Figures and so that, when the burner is mounted to the bottom or top wall of the oven, the screw 106 is always on the accessible side.

The outer face 101 of the upper half shell 1 has, at each of the two opposite ends, a bolt 9 for centering and fastening a parabolic reflector 10. The two bolts 9 are threaded and extend perpendicular to the face 101 of the half shell 1. In coincidence with the bolts 9, the parabolic reflector has a pair of holes 110, for the passage of the bolts 9, and the parabolic reflector is secured by tightening a threaded nut on each of said bolts.

Near the truncated end of the tubular burner body, at the end portion of one of the two stems of the pilot burner, the parabolic reflector has a slot-like opening formed by breaking the material of the parabolic reflector and bending the edges of the slot toward the pilot, in such a manner as to form a tube 13 which opens at one end in front of the gas/air mixture outlet holes 501 and wherein a part of this mixture is conveyed for manual ignition (so-called ignition tube).

The burner further includes a mounting 14 for supporting a flame detecting thermocouple 15 and an igniter 16. At one end, the mounting is conformed as a U-shaped arm 114, with a pair of holes 214 formed on a side wall thereof, each hole being coaxial to a corresponding hole 214 on the opposite wall. The igniter 16 and the thermocouple 15 are designed to be introduced axially to length in each of the coaxial holes 214. An elastic clip 17 is provided for axially securing the thermocouple 15 and another one is provided for axially securing the igniter 16. The mounting 14 also includes a substantially flat extension 314 for attachment to the upper half shell 1 of the burner body. In fact, a hole 414 is formed at the end of this extension 314, for passage of the parabolic reflector fastening bolt 9, which is located at the flame arc forming head end, and the extension 314 is clamped above and against the parabola reflector 10 at the same time as the latter is clamped against the outer face 101 of the upper half shell 1. Each of the two side edges of the extension 314 of the mounting 14 has, at the hole 414, a transverse tab 514, which is oriented toward the upper half shell 1, so as to form a bridge-like end which, through a pair of corresponding apertures 210, formed in the parabolic reflector 10, overlaps the initial section of the U-shaped groove formed on the outer face 101 of the half shell 1 and corresponding to the U-shaped recess. By this arrangement, any rotation of the mounting 14 is prevented. As is apparent from the Figures, the mounting 14 has a first section oriented opposite the gas/air mixture inflow direction, a second curved section, which together form the extension for attachment to the upper half shell 1, and a third section, substantially corresponding to the U-shaped arm 114, which is oriented in the inflow direction, particularly substantially through 45°. Since the thermocouple 15 and the igniter 16 are secured perpendicular to the longitudinal extension of the arm 114, they are oriented substantially through 45° with respect to the mixture inflow direction and their ends are situated at the flame arc forming head.

Referring now to FIGS. 5 to 12, a second embodiment of a burner according to this invention is shown. This burner is composed of two half shells, an upper half shell 18 and a lower half shell 19, each including the upper half shell and the lower half shell of the venturi tube respectively. Therefore, in this case the half shells of the venturi tube are made of one piece as axial extensions of the half shells 18, 19 which form the tubular burner body, whereby, in the assembled condition, the venturi tube is coaxial to the tubular burner body. The two half shells 18, 19 are elongated and respectively have an upper face 218 and a lower face 219 that are substantially flat and form, in the joined condition, a tubular body which also has an elongated but substantially flat shape. The junction plane between the two half shells 18, 19 is substantially parallel both to the bottom and/or the top of the oven and to the outer faces 218, 219 of the two half shells 18, 19, the latter being therefore parallel. The two half shells 18, 19 are joined together by crimping the two longitudinal side edges which have peripheral flanges 118, 119, to be bent and later riveted or drawn in such a manner as to form a pair of side channels, the outer side walls thereof being disposed opposite to the corresponding side walls of the upper half shell 18 and at a predetermined distance therefrom. Each side wall of said half shell 18 has a row of aligned holes 501 to supply the gas/air mixture to the corresponding channel which forms a branch of the pilot burner, as is better detailed below. Each side wall of the upper half shell 18 has an additional row of larger holes 601, which are not present at the flame arc forming head and form the main gas/air mixture outlet holes.

Figure 5:
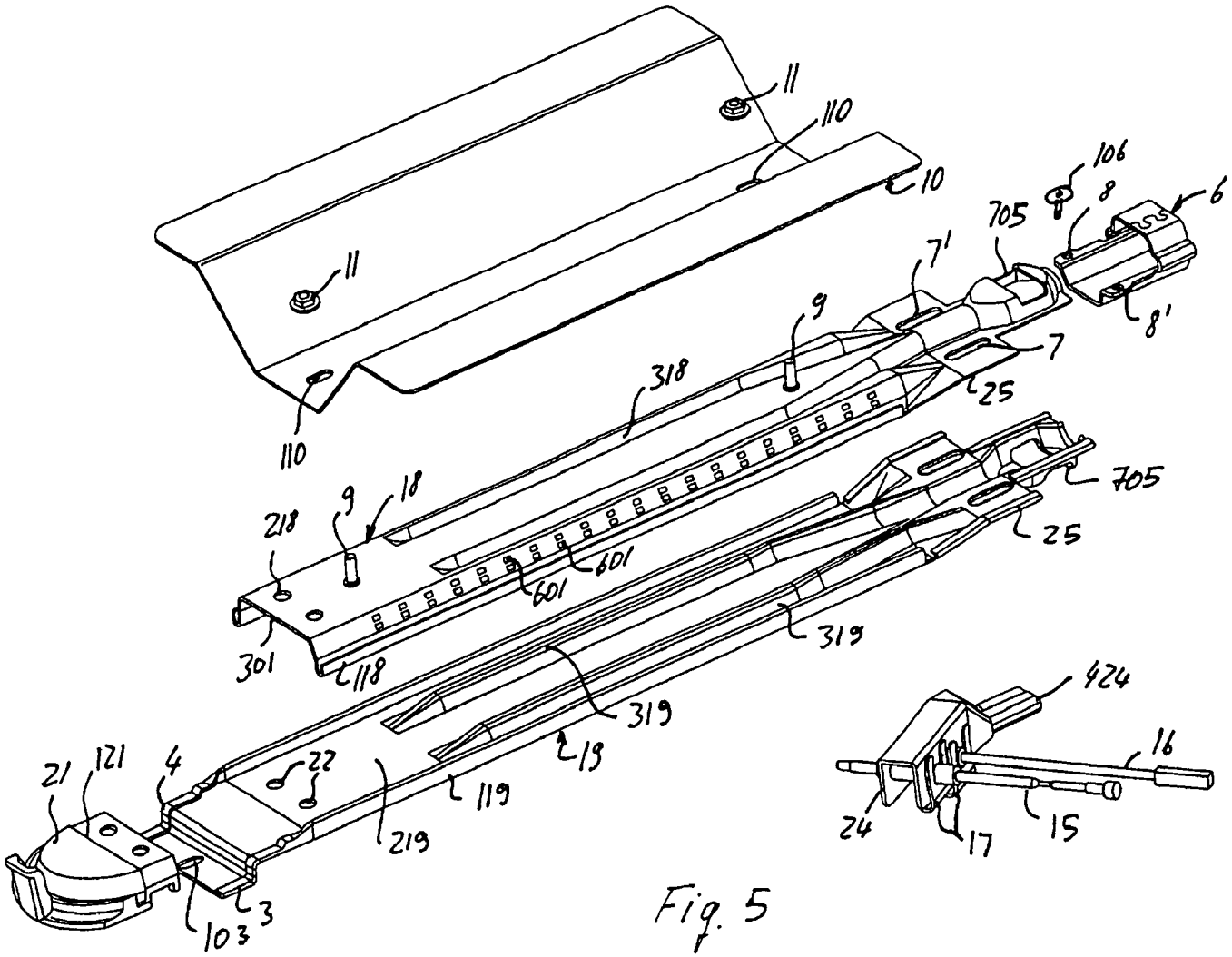
FIG. 5 is a perspective exploded view of a second embodiment of the burner according to the invention.
Figure 6:
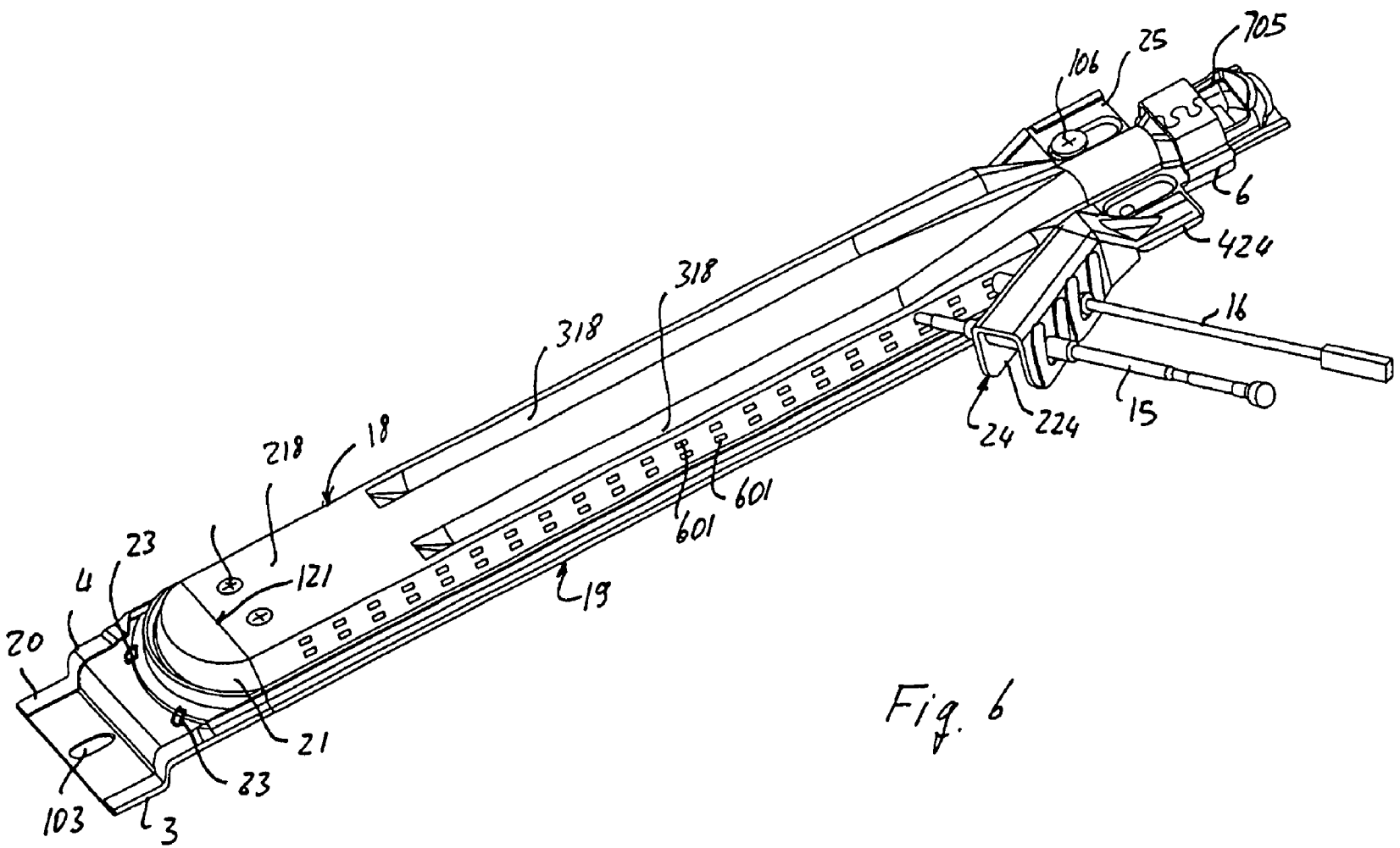
FIG. 6 is a view of the burner as shown in FIG. 5 in the assembled condition.
Figure 7:
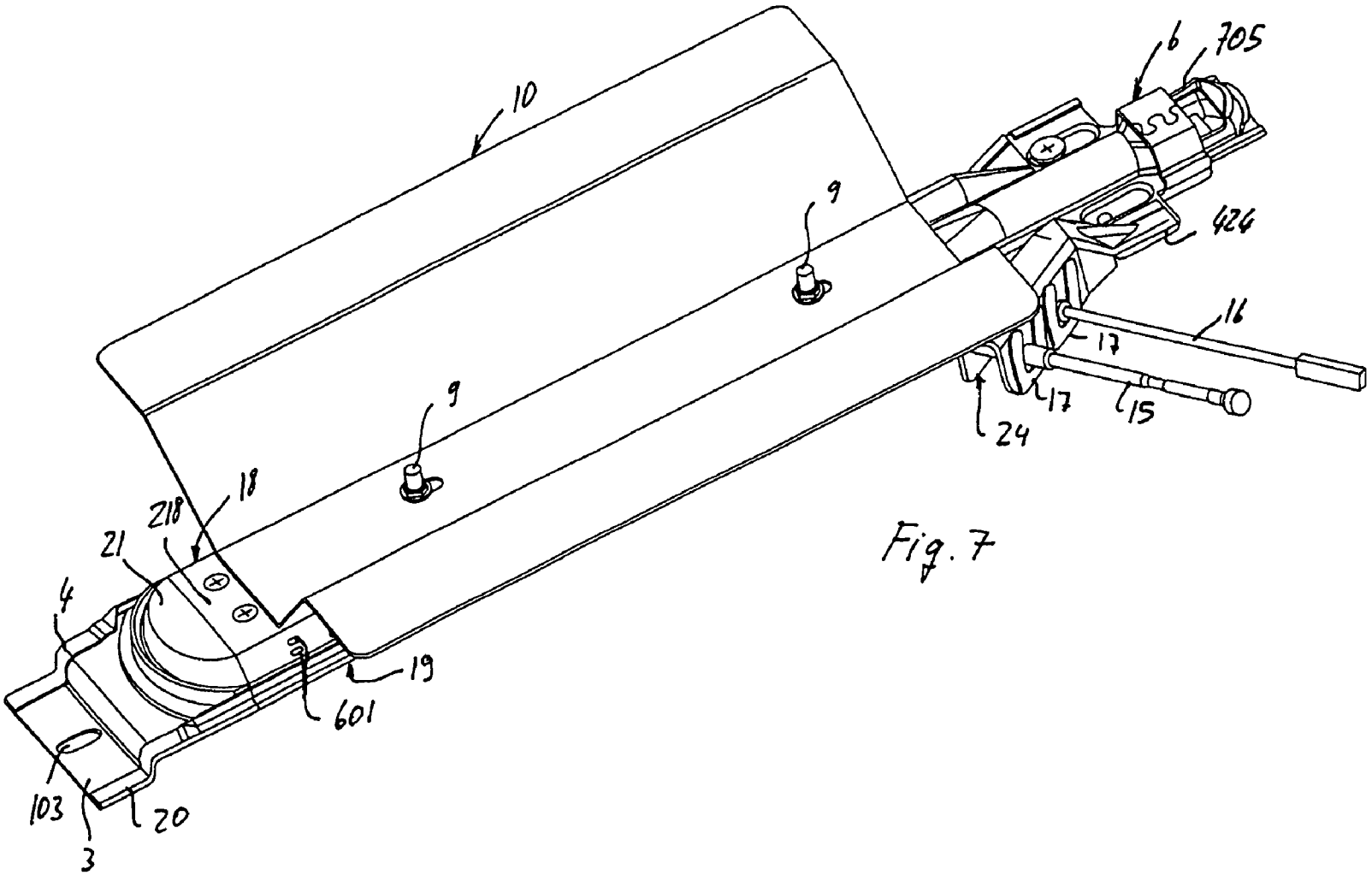
FIG. 7 is a perspective view of the burner as shown in FIGS. 5 and 6 in the assembled condition.

The tubular body of the venturi tube, composed of the two half shells 18, 19, has a substantially funnel-like shape, tapering in a direction opposite to the gas/air mixture inflow, as shown in the arrow of FIG. 5, and has a pair of primary combustion air intake apertures 705. The venturi tube further has a tubular sleeve 6 which can slide axially along the venturi tube from a position in which it substantially completely closes said intake apertures 705 to a position in which it substantially completely opens them, thereby providing adjustment of the stoichiometric gas/air ratio. This sleeve 6 has a screw 106 for axially locking it in the proper position. This screw 106 is tightened, through a slot 7 of a side tab of the venturi tube, in a threaded hole 8 of a side tab of the sleeve 6, to lock the latter in the proper axial position. It shall be noted that the venturi tube has another tab, in a diametrically opposite position, which has a slot 7', identical to the slot 7 and disposed symmetrically with respect to it, so that the sleeve 6 may be disposed in an upside-down position with respect to the Figures and so that, when the burner is mounted to the bottom or top wall of the oven, the screw 106 is always on the accessible side.

The end of each of the two half shells 18, 19 opposite to the venturi tube end is truncated, but the end of the lower half shell 19 extends further than that of the upper half shell 18 and has a deformation of such a shape as to form a base 3 in which a hole 103 is formed to fasten the burner to the bottom or the top wall of the oven. The side flange 119 of the lower half shell 19 is further bent on itself, in this section, in such a manner as to form a stiffening side edge 20. The shape deformation of the end of the lower half shell 19 generates transverse folds 4 that further stiffen this section. This end of the tubular body, opposite to the venturi tube end, is closed by a separate member, obtained by die-casting, which is also the flame arc forming head 21 of the burner. The latter has the shape of a half-shell and is force fitted inside the tubular body of the burner up to abutment of the end edge 301 of the upper half shell 18 against an end-of-stroke abutment 121 provided on the outer surface of the flame arc forming head which rests, in the inserted position, on the extension of the lower half shell 19. The flame arc forming head 21, which is situated inside the tubular body of the burner, when in the mounted condition, has two tubular bushings 221 which extend perpendicular to the inner surfaces of the two half shells 18, 19 and has an axial length which substantially corresponds to the distance between these two surfaces. The flame arc forming head 21 is locked by deforming, from the outside, the surfaces 218, 219 and by creating four inside projections, like circular bosses 22, each engaged with an open end of the tubular bushings 221. The extended section of the lower half shell 19 further has a pair of apertures which form a pair of tabs 23 to be bent and compressed above a substantially semicircular outer peripheral flange 321 of the flame arc forming head, which has the function to further secure it and to prevent removal thereof.

The outer lateral surface of the flame arc forming head 21 further has a substantially semicircular channel 421 whose inner wall has a row of holes 501 to supply the gas/air mixture. The two opposite ends of this channel 421 are connected with the two side segments of the pilot burner, which are made of one piece with the burner body, by joining the side edges of the two half shells 18, 19 as described above. By this arrangement, the pilot burner is arranged to have a U profile, with the curved portion in the area of the flame arc forming head 21 and the two stems substantially ending where the venturi tube starts. In a substantially intermediate position of the semicircular channel 421 a duct 521 is provided, which extends perpendicular to the junction plane between the two half shells 18, 19 and forms the burner ignition tube. The two tubular bushings 21 are connected to each other, from the inside, by an arched wall member 621 which extends at a certain distance from the inner arched wall of the flame arc forming head 21 and generates a channel to convey the gas/air mixture to the holes 501 for supplying the pilot burner in the area of the flame arc forming head 21.

The outer face of each of the two half shells 18, 19 has, at its side edge, a longitudinal groove which generates a pair of longitudinal inner recesses 318 of the upper half shell 18 and a pair of longitudinal inner recesses 319 of the lower half shell 19. These recesses form internal walls that convey and evenly distribute the gas/air mixture to the outlet holes 501, 601. These longitudinal recesses branch off the venturi tube portion and end at a certain distance from the tubular body end that carries the flame arc forming head 21. The two lower recesses 319 are aligned with the two upper recesses 318 respectively and have such a depth as to be in contact with each other in the venturi tube portion. In the burner portion, the two lower recesses 319 have a smaller height and such that their apices extend to a certain distance from the apices of the corresponding upper recesses 318 respectively, to form a pair of longitudinal side slots for conveying the gas/air mixture transverse to the flow direction. Here again, this creates a central preferential passage for the gas/air mixture, whereby the holes 501, 601 at the end of the tubular body which carries the flame arc forming head 21 are supplied with said mixture at a higher pressure than all other holes that are at a shorter distance from the gas/air mixture supplying venturi tube, so as to obtain a substantially even output through the holes 501, 601. In the section connecting the tubular body and the venturi tube, the distance between the upper recesses 318 progressively decreases in a direction opposite to the flow direction, and this also happens, in a corresponding manner, for the lower recesses 319 so as to form a funnel-like section, typically found in many venturi a tube types, which generates the air intake effect through the apertures 705.

The outer face 218 of the upper half shell 18 has, at each of the two opposite ends, a bolt 9 for centering and fastening a parabolic reflector 10. The two bolts 9 are threaded and extend perpendicular to the face 218 of the half shell 18. In coincidence with the bolts 9, the parabolic reflector has a pair of holes 110, for the passage of the bolts 9, and the parabolic reflector is secured by tightening a threaded nut on each of said bolts.

The burner further includes a mounting 24 for supporting a flame detecting thermocouple 15 and an igniter 16. At one end, the mounting is conformed as a U-shaped arm 224, with a pair of holes 324 formed on a side wall thereof, each hole being coaxial to a corresponding hole 324 on the opposite wall. The igniter 16 and the thermocouple 15 are designed to be introduced axially to length in each of the coaxial holes 324. An elastic clip 17 is provided for axially securing the thermocouple 15 and another one is provided for axially securing the igniter 16. The arm 224 includes an extension plate 424 which has a U-bent edge 524 which is meant to house the peripheral edge of an outer tab 25 of the venturi tube, whereas the opposite edge has a pair of U-bent tabs 624 on the same side as the edge 524 that form a pair of teeth 624, well fitted in two corresponding holes 125 formed on the outer tab 25 of the venturi tube. The plate 424 further has, in a substantially intermediate position between the two opposite bent edges, a step 724 whose front is turned toward the edge 524 and that, when the mounting 24 is secured, causes an elastic deformation of the outer tab 25 of the venturi tube for further retaining the mounting 24 in position. When the mounting 24 is fitted on the burner, the U-shaped portion of the arm is oriented in the gas/air mixture inflow direction, which forms with said direction an angle of about 45°, whereas the thermocouple 15 and the igniter 16 are oriented in such a manner as to form with said direction an angle of about 135°, and their inner ends are directly adjacent to the gas/air mixture outlet holes 501, 601.

Figure 13:
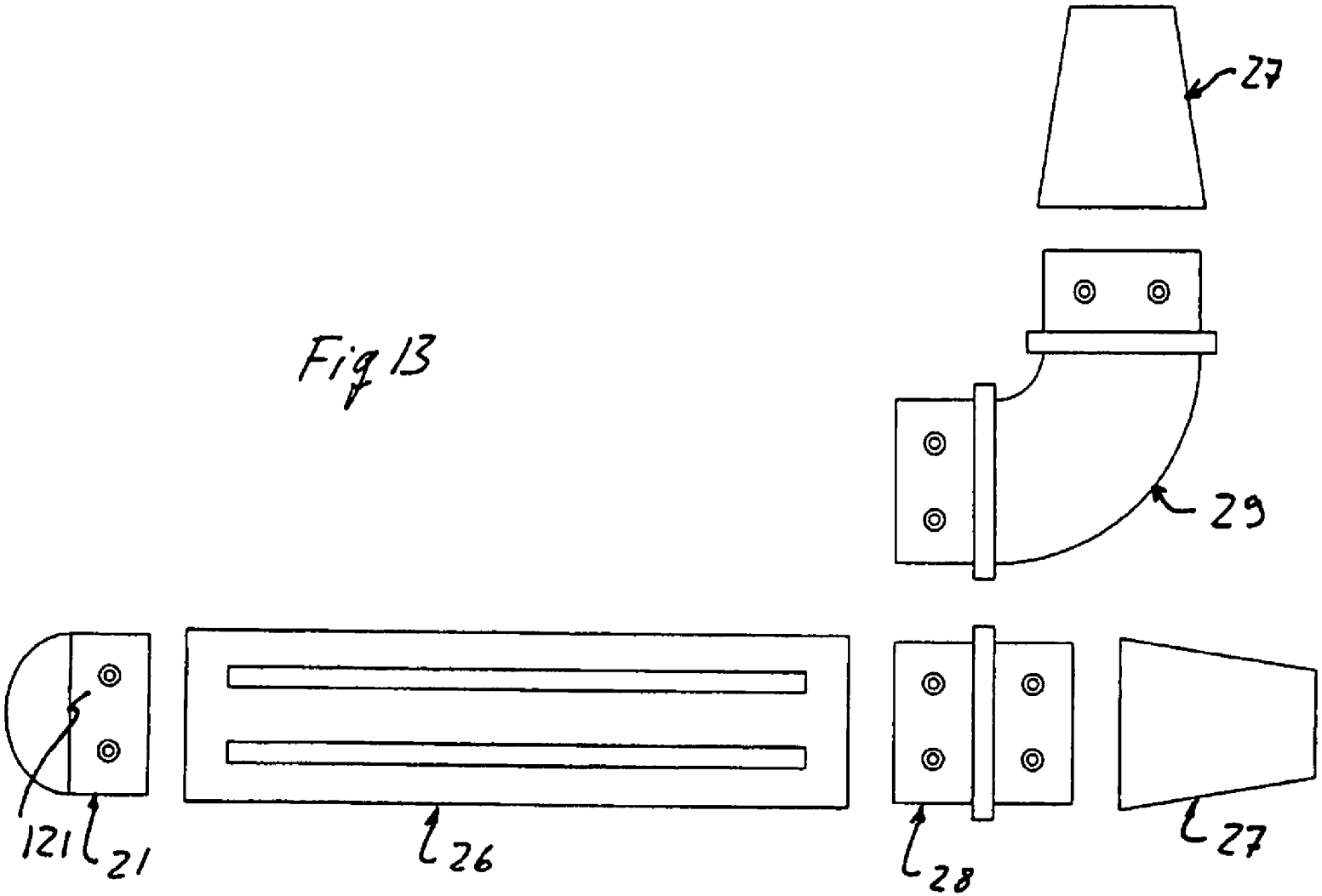
FIG. 13 is a simplified top plan and exploded view of a third embodiment of a burner according to this invention, which includes two different embodiments of a joint for connection of the venturi tube to the tubular body of the burner.
Figure 14:
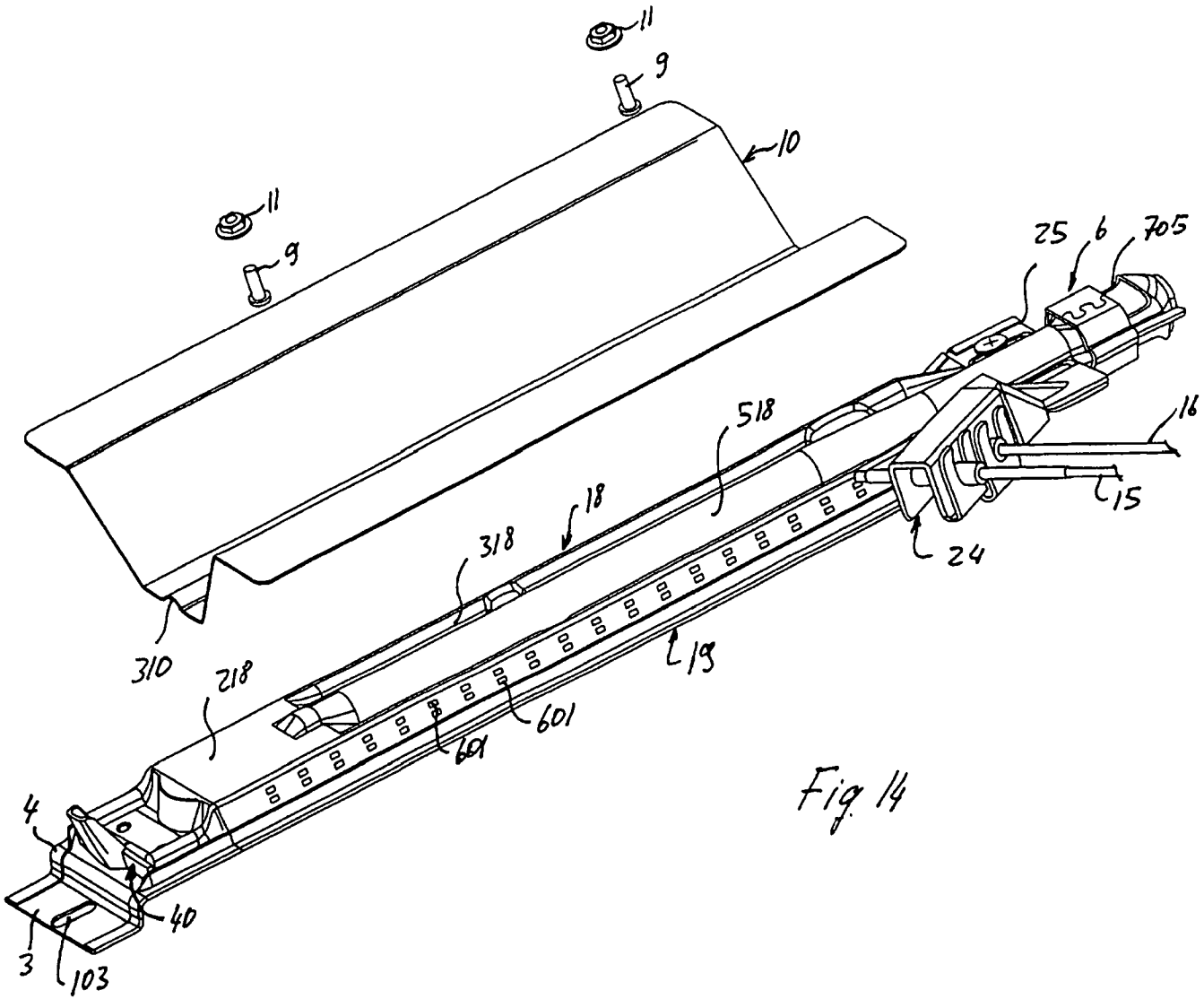
FIG. 14 is a perspective exploded view of a variant embodiment of the burner as shown in FIGS. 5 to 12.
Figure 15:
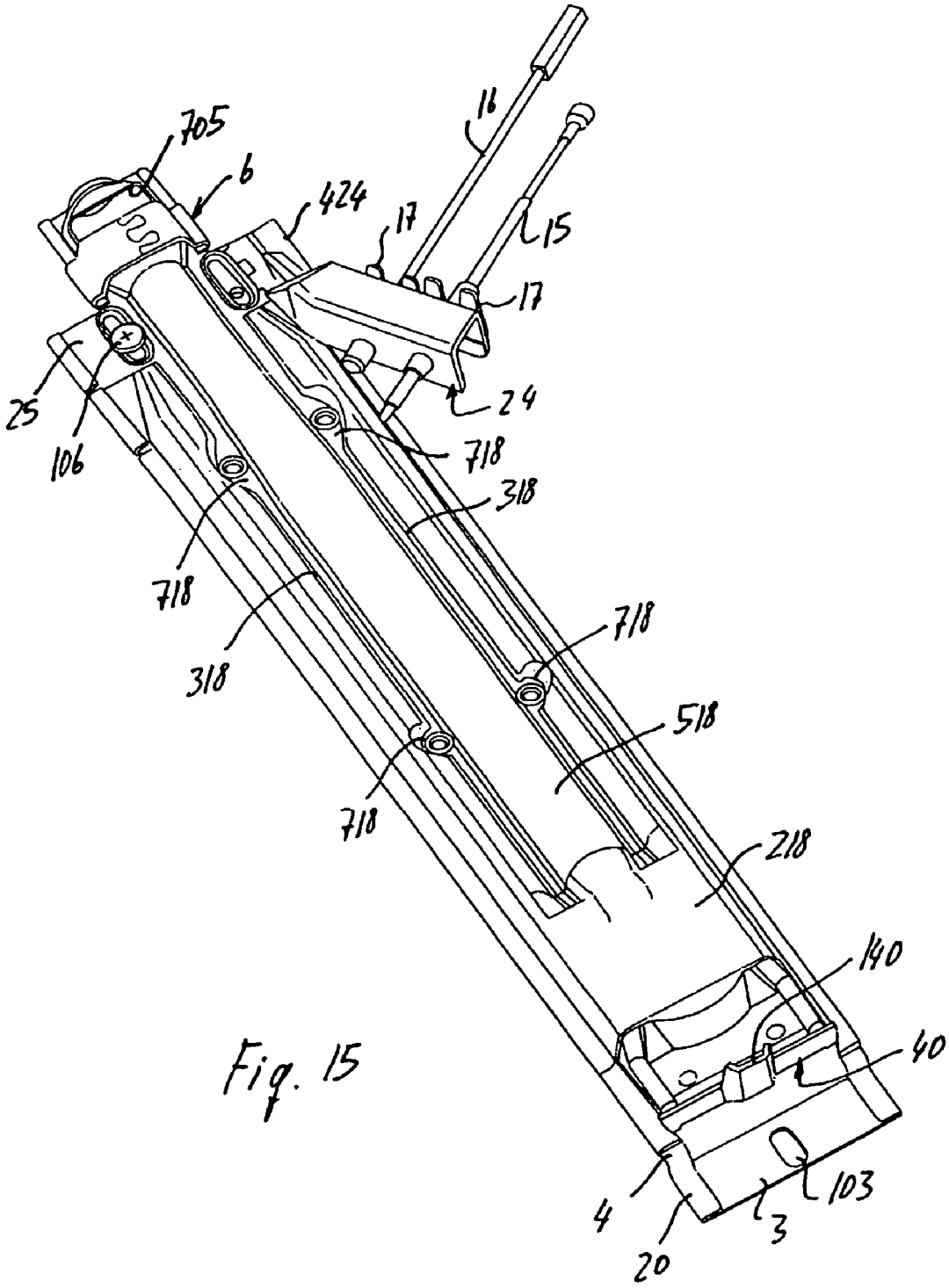
FIG. 15 is a top perspective view of the burner without the parabola.
Figure 16:
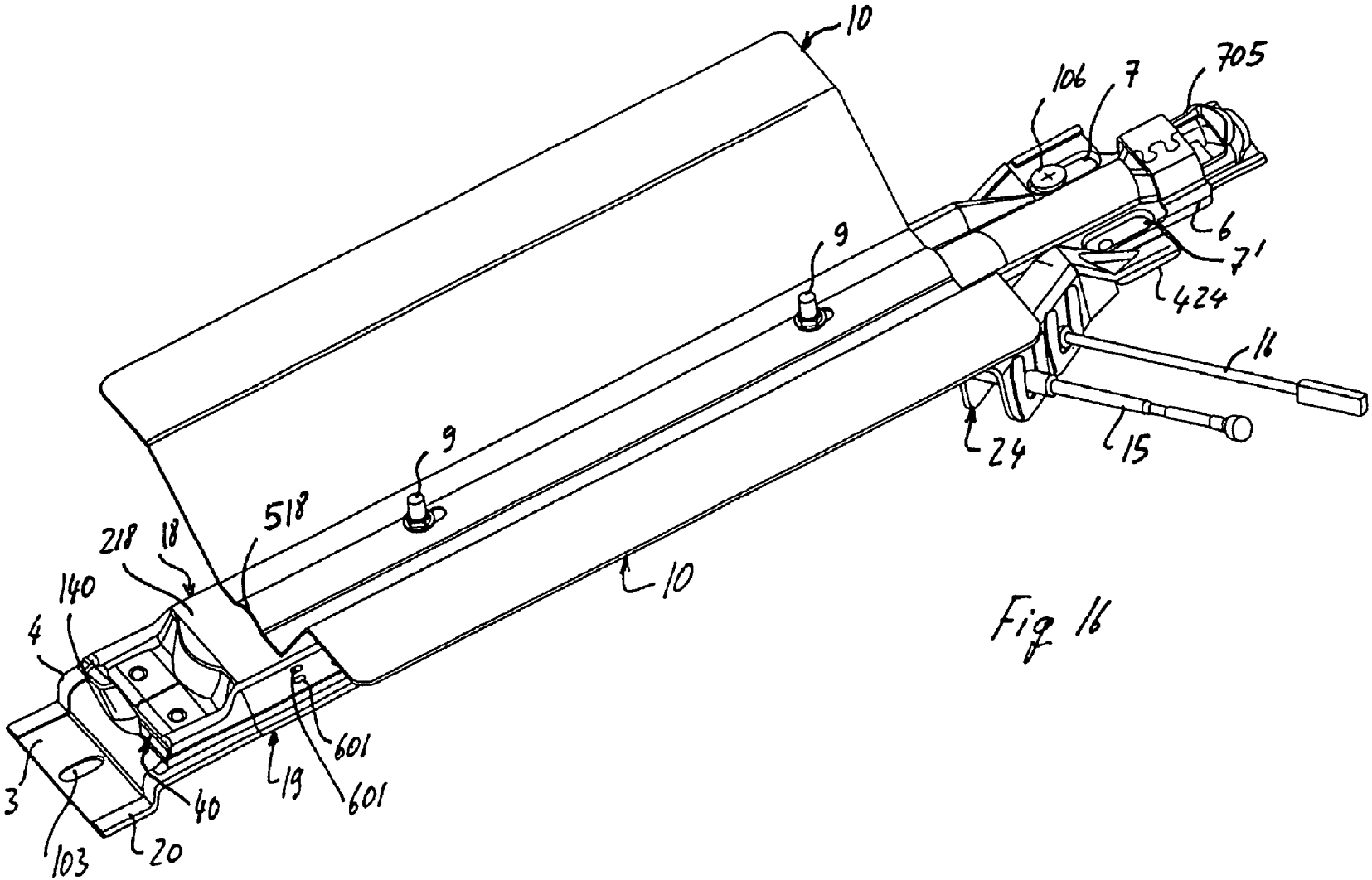
FIG. 16 is a view of the burner as shown in FIGS. 14 and 15, with the parts of the exploded view of FIG. 14 being shown in the assembled condition.
Figure 17:
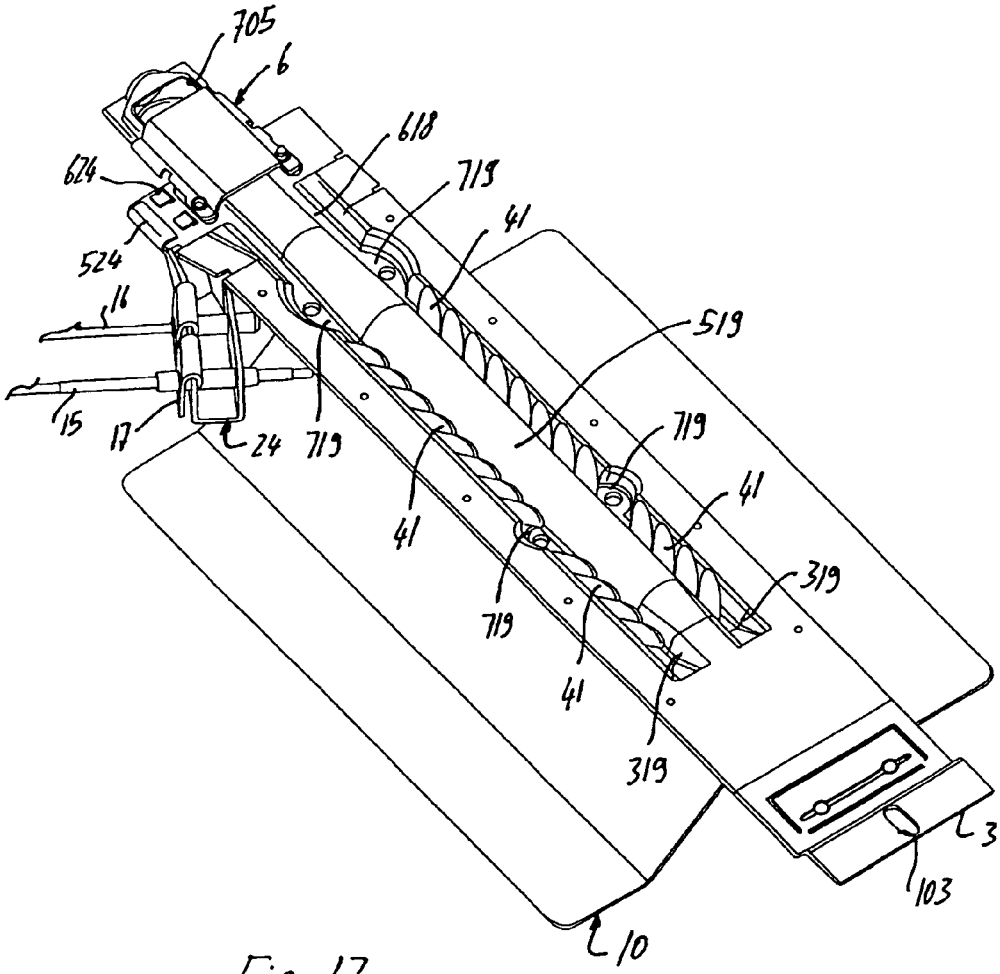
FIG. 17 is a perspective view of the lower face of the burner as shown in the preceding Figures.
Figure 18:
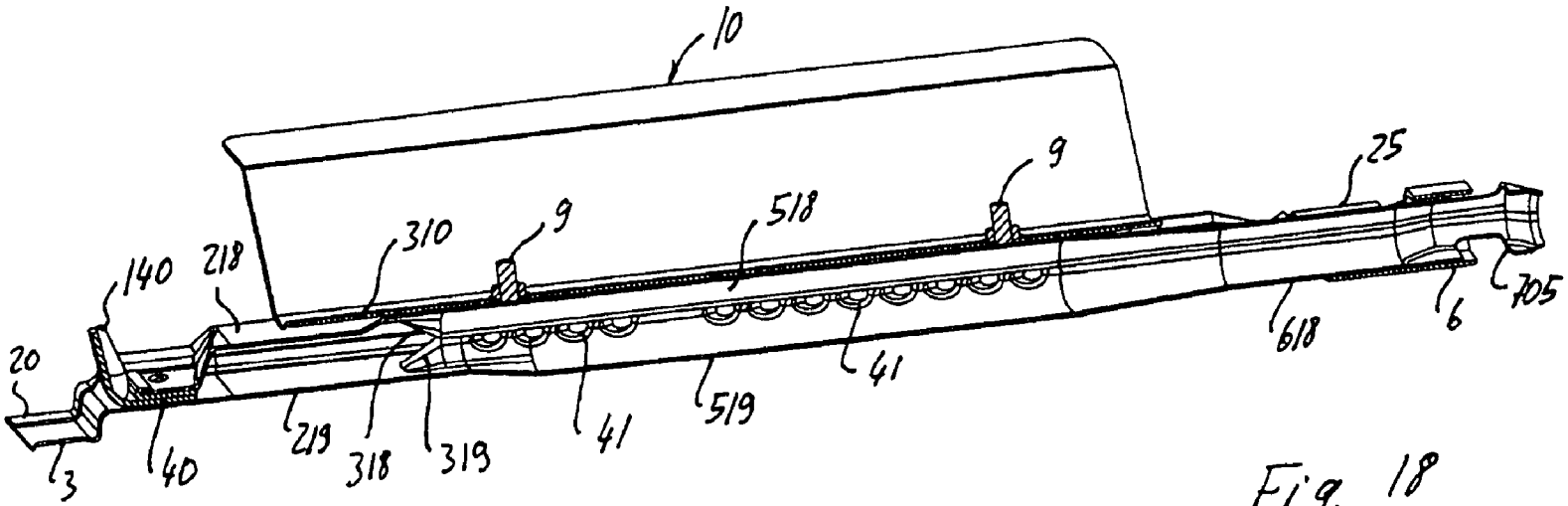
FIG. 18 is a perspective and sectional view, as seen along a median longitudinal plane of the burner perpendicular to the outer surface of its shells.

Referring now to FIG. 13, a third embodiment of the burner of this invention is shown, in which both opposite ends of the tubular body of the burner are truncated and the venturi tube 27 is provided as a separate body, to be secured onto one of these ends, by using a method like the one described above for the flame arc forming head 21. The opposite end is closed by a flame arc forming head 21, which may have the same characteristics as described above. Alternatively, the venturi tube 27 may be connected to the tubular body 26 of the burner through a tubular joint, particularly made of a die cast material, which may be rectilinear 28 or curved 29. In the first case, the venturi tube 27 is aligned with the tubular body 26, whereas in the second case it extends transverse thereto.

FIGS. 14 to 31 show a fourth embodiment of the inventive burner, wherein a few changes are made to the two half shells 18 and 19, crimped together to form the burner body, as compared with the above description. The walls of the two half shells 18, 19 between the two inner U- or V-shaped recesses 318, 319, which correspond to the two lateral longitudinal grooves on the outer side of the two half shells, have a cylindrical shape and, for each half shell, said outer wall portion substantially forms a cylindrical wall with an angular extension of about 180°. This is designated with numerals 518 and 519 in FIGS. 14 to 31. This portion, having a substantially hemi-cylindrical shape, extends continuously from the venturi tube section, designated with numeral 618 to an area at a certain distance from the opposite end of the burner body, where the two half shells 18 and 19 change back to a flat profile, relative to the wall that is substantially parallel and opposite to the junction plane therebetween. These areas are numbered 218 and 219. The hemi-cylindrically shaped portions 518, 519 of the two half shells 18 and 19 are connected with the bottom surface of the two lateral outer grooves which coincide with the internal recesses 318, 319 and also form their lateral, longitudinal innermost walls, with respect to the median longitudinal axis of the burner. Particularly, the cylindrical portions 518, 519 end substantially at the same level as the grooves that coincide with the inner recesses 318, 319 on the side turned toward the end with the flame arc forming head 40. Obviously, as is apparent from the Figures, the parabola 10 itself, which is designed to be secured to the face of one of the two half shells 18, has a cylindrical wall portion 310, where it is in contact with the cylindrical portion 518.

According to another characteristic, the apex of the cylindrical portion is arranged to extend flush or substantially flush with the rest of the wall of the face parallel to the separator plane between the two half shells 18 and 19. In this case, the cylindrical portions 518 and 519 project to a very small extent or do not project at all out of the peripheral wall portions of the half shell faces. The sections 518, 519 may be also arranged to be arched with a non cylindrical profile, for instance slightly flattened and/or to have either a shape or a radius that changes along the longitudinal extension of this sections 518, a 519 even in different manners for the two half shells.

In accordance with yet another characteristic, which differentiates this embodiment from the preceding ones, the recesses 318, 319 or only one of them 318 or 319, may have internal crests, having a wavy profile, or forming such recessing or projecting grooves as to create one or more transverse channels that transversely cut the grooves and act as communication channels 41 between the central chamber of the burner, composed of the cylindrical portions 518, 519 of the two half shells 18, 19 and the peripheral compartments, that are delimited on the one hand by the peripheral wall of the burner and on the innermost side by the outermost side walls of the recesses 318, 319.

The transverse channels 41 may be distributed along the cylindrical section 518, 519 of the burner and/or inclined in any manner. Particularly, a substantially even distribution was selected, with respect to the distance between the transverse channels 41. Further, the channels are disposed in a fishbone arrangement, and the end for communication with the cylindrical portion is axially stepped back with respect to the end for communication with the peripheral compartments of the burner, which in turn communicate with the outside through the holes 601, 501. In this embodiment, the transverse channels 41 are oriented parallel to each other and are also arranged symmetrically to the median longitudinal plane of the burner, which is perpendicular thereto. Nevertheless, the invention is not intended to be restricted to a parallel and/or symmetric orientation of the transverse channels 41, which may be disposed in different positions on each of the two longitudinal halves of the burner and/or have different orientations.

Different variants may be also provided regarding the two recesses 318, 319. In a first case, the two lateral recesses 318, 319 may be so disposed relative to each other or have such projections as to never come in contact with each other all over their length or over a part of it, thereby forming, over at least a part of their length or all over it, a transverse slot through which gas is conveyed from the cylindrical portion 518, 519 to the side walls of the burner. In this case, this conveying slot would widen at the transverse channels 41. Alternatively, the two recesses 318, 319 may be in contact with each other over at least a part of the length of the cylindrical portion 518, 519 of the burner, whereby in this case, and for the contact portions between the two recesses, gas would only pass to the lateral portions of the burner through the transverse channels 41.

In the embodiment as shown in the Figures, the two recesses are not in contact with each other, except in two locations 18 of the end portion associated to the venturi tube and of the end portion associated to the flame arc forming head. In these mutual contact portions 718 of the crests of the inner recesses 318, 319, intermediate fastening means, i.e. clips are advantageously provided to join together the two half shells 18 and 19.

Obviously, the characteristics of this embodiment may be provided, as far as possible, in combination with any apparently compatible characteristic of the preceding embodiment, e.g. with the use of an offset, offline and integral venturi tube and/or of an integral flame arc forming head like in the first embodiment as shown in FIGS. 1 to 4, the use of the flame arc forming head as described in the embodiment of FIGS. 5 to 12 or in the modular embodiment as shown in FIG. 13.

FIGS. 14 to 31 show further variants that may be provided in combination with the other characteristics of the above embodiments, as regards the flame arc forming head 40.

Unlike the description of the embodiment as shown in FIGS. 5 to 12, the flame arc forming head 40 of FIGS. 14 to 31 is made by metal sheet blank molding, such as metal stamping.

Figure 9:
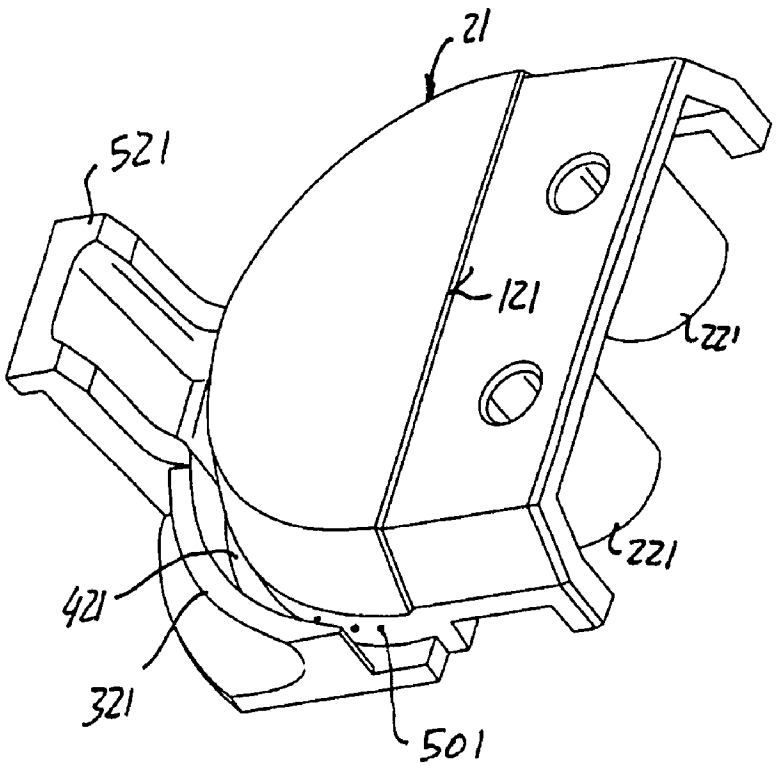
FIG. 9 is a perspective view of the flame arc forming head provided in combination with the burner as shown in FIG. 5.
Figure 10:
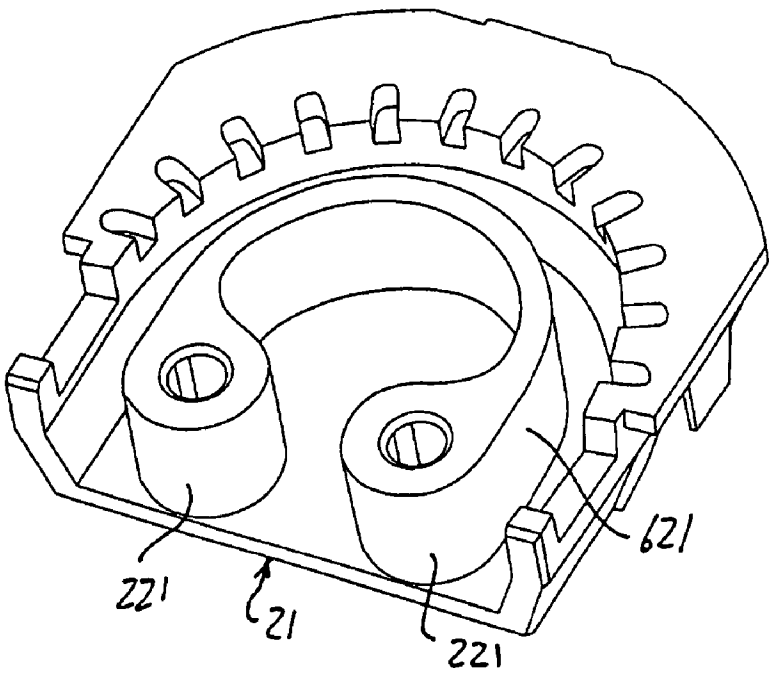
FIG. 10 is a perspective view of the lower face of the flame arc forming head as shown in FIG. 9.
Figure 12:
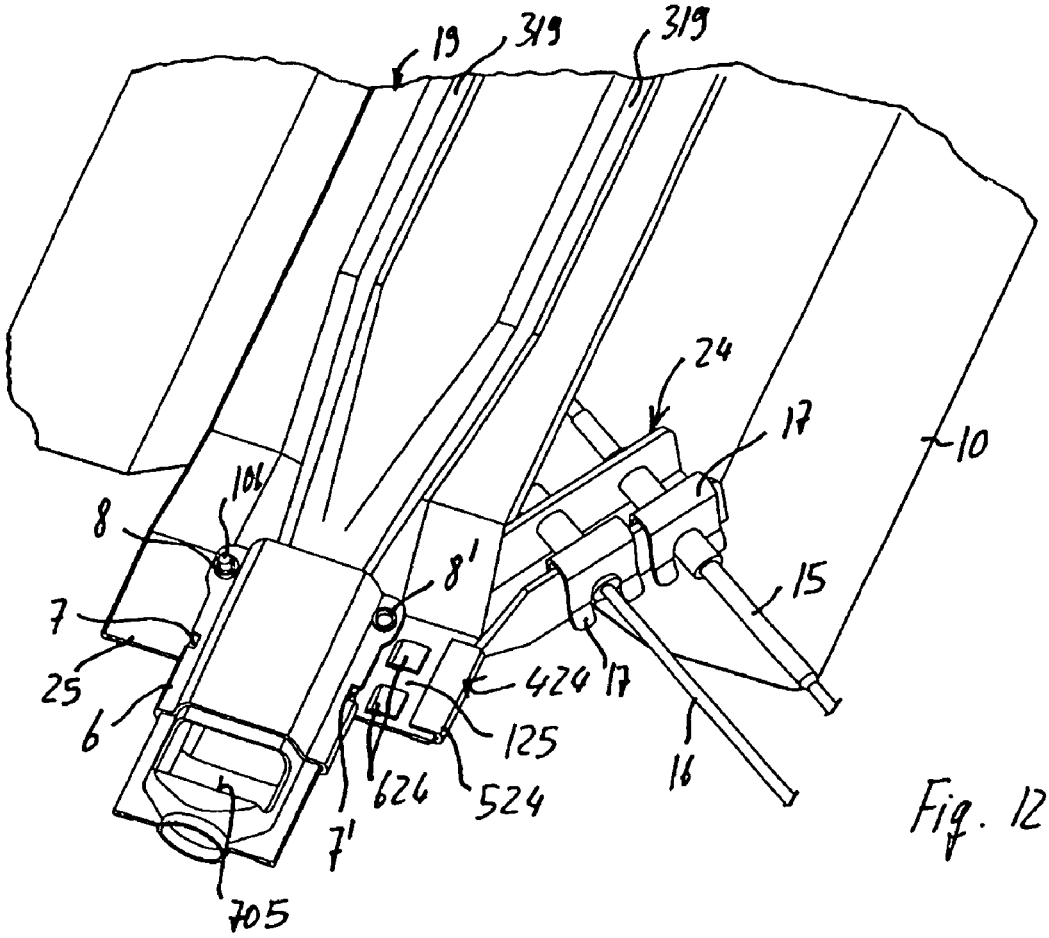
FIG. 12 is a perspective view of the mounting as shown in FIG. 11, when fitted on the burner as shown in FIGS. 5 and 6.
Figure 11:
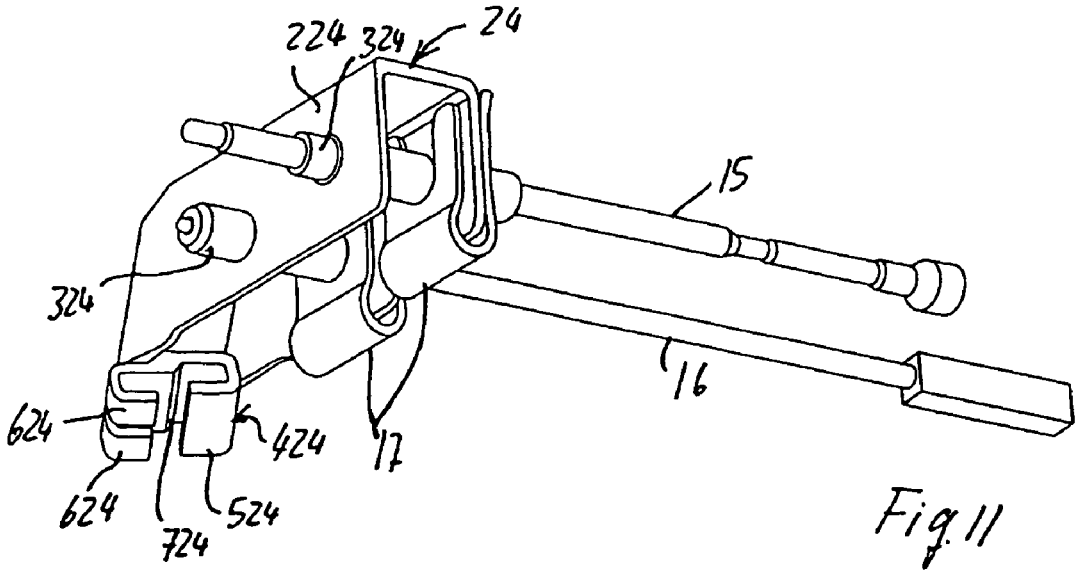
FIG. 11 is a perspective view of an igniter and a thermocouple, when fitted on a mounting according to this invention.

In this case, the flame arc forming head 40 has an integrated ignition tube 140 like in FIGS. 9 and 10. The latter has a rectangular or anyway squared shape. A central flattened portion 240, i.e. a plate, has two holes or recesses 340 that are separated by a central axial groove 440, which ends into a transverse groove 540, delimited by an end wall 640 that extends centrally into a spout, the latter forming the ignition tube 140. The transverse groove 540 is obtained by forming a thinning step in the flattened portion 240.

The flattened portion 240 is delimited at its sides by perpendicular flanks 740 which also end at a certain distance from the end wall 640 and substantially flush with the step of the flattened portion 240. An array of axial holes or channels 840 crosses the flattened portion from one side to the other. The axial through holes or channels 840 are formed at such a height that one of their ends opens into the transverse groove 540, whereas the other one opens into the opposite parallel edge of the flattened portion 240. Therefore, the ducts or through holes 840 provide communication between the transverse groove 540 and said opposite end edge of the flame arc forming head.

The flanks 740 have an axial groove 940 in an intermediate portion of their outer wall, whereas fastening recesses are also provided on the bottom, or the fastening holes 340 extend through the thickness of the flattened portion 240. In both cases, the fastening holes or recesses 340 open onto flattened portion side opposite to the ignition tube 140, in an elongated transverse sealing recess 1040.

As it is apparent from the Figures, the flame arc forming head is obtained by bending a metal sheet during a molding process. The channels or axial holes and the median axial groove are obtained by prior formation of holes and grooves in the unbent metal sheet. The flame arc forming head so obtained is much less expensive than the flame arc forming head as shown in FIGS. 9 and 10, which is made by die-casting.

Furthermore, the flattened portion has another tab on the face turned toward the ignition tube 140, at the edge which delimits the transverse groove 540. The tab 1140 is divided by the median longitudinal groove 440 and extends above and at a certain distance from the flattened portion 240. The tab 1040 is turned toward the opposite transverse edge of the flattened portion 240 and forms a pocket for accommodating the transverse edge of the lower half shell 18 of the burner, thereby additionally securing the flame arc forming head to the burner by clamping it between the tab 1040 and the flattened portion 240. The tab 1040 also acts as wall for abutment of the flame arc forming head 140 on the end of the burner and also allows—for an improvement of the sealing effect.

The flame arc forming head of this embodiment is designed to be fitted to the end of the burner body by fastening the metal walls thereof onto the surfaces of the flame arc forming head itself. The latter are conformed in such a manner as to penetrate the recesses or the holes 340 and the elongated transverse recess 940 and as to also overlap the flanks 740.

Figure 19:
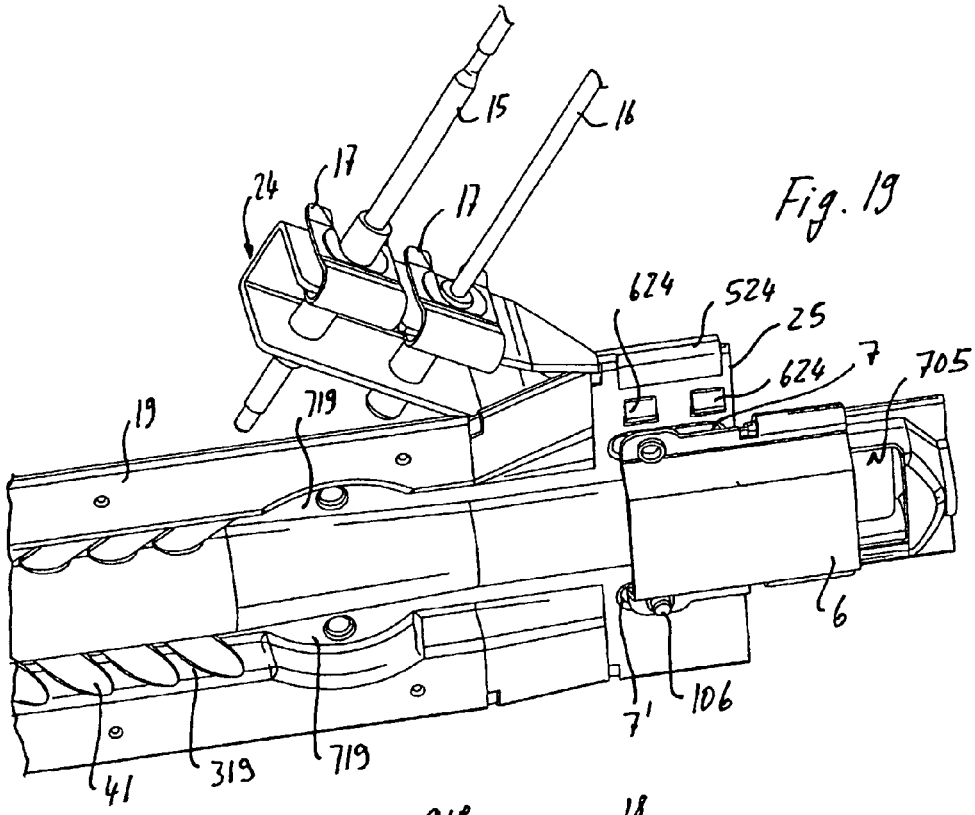
FIG. 19 shows an enlarged detail of the end section associated to the venturi tube and of the lower side of the burner as shown in the preceding FIGS. 14 to 18.
Figure 20:
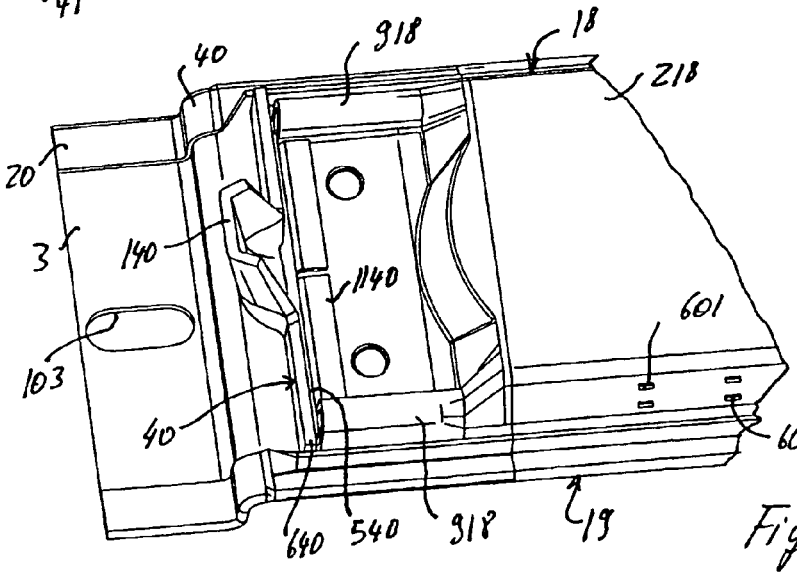
FIG. 20 is a perspective view of the end of the burner as shown in the preceding FIGS. 14 to 19, which end is opposite to the one associated with the venturi tube.
Figure 21:
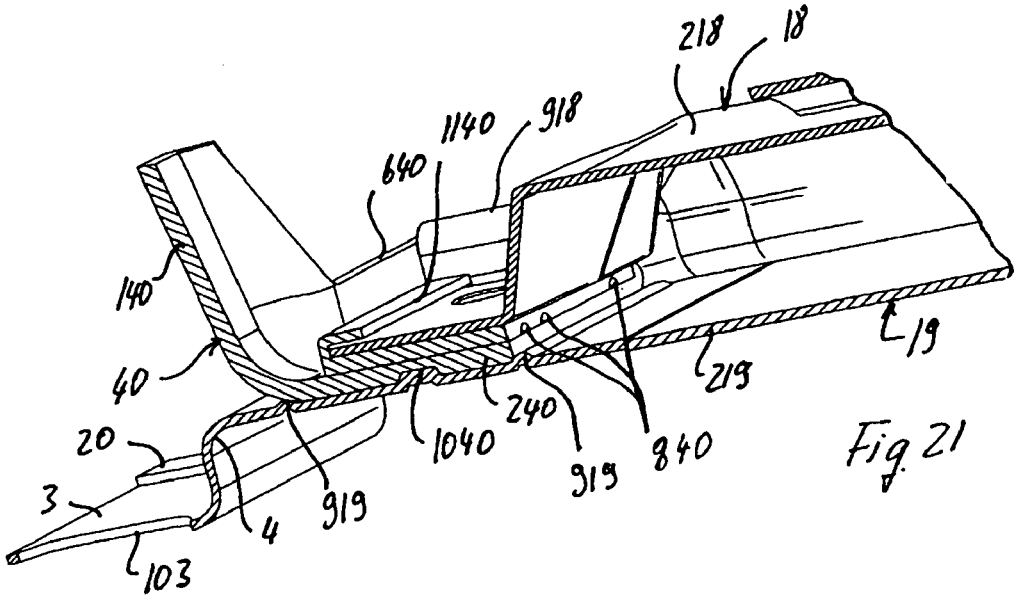
FIG. 21 is a cross-sectional perspective view of the area shown in FIG. 20.
Figure 22:
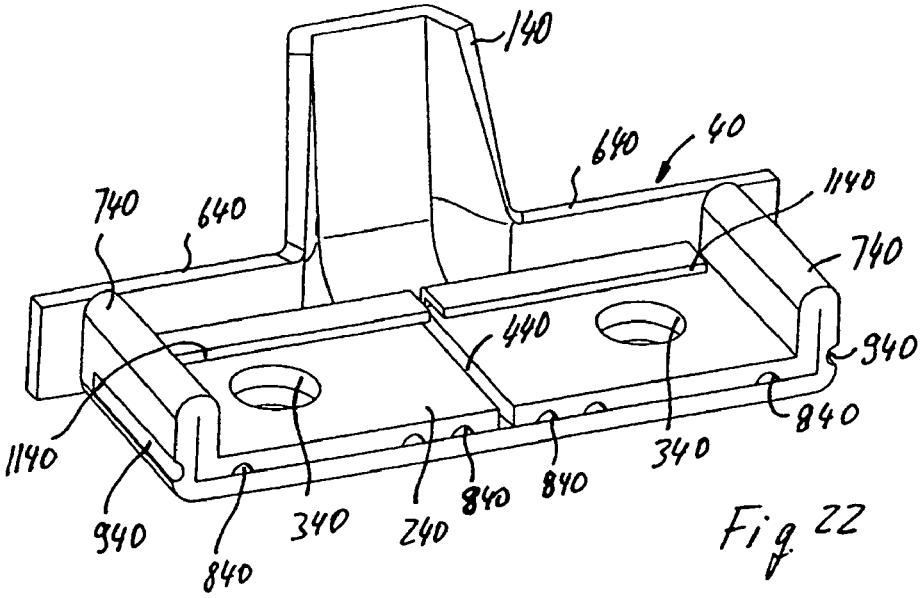
FIGS. 22 to 24 are different perspective views of the flame arc forming burner head as shown in FIGS. 13 to 20.
Figure 23:
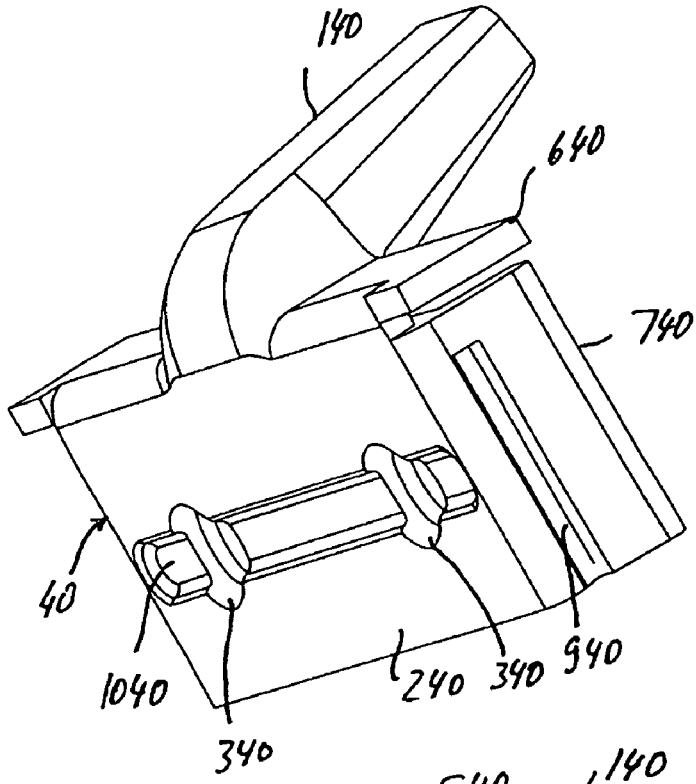
Figure 24:
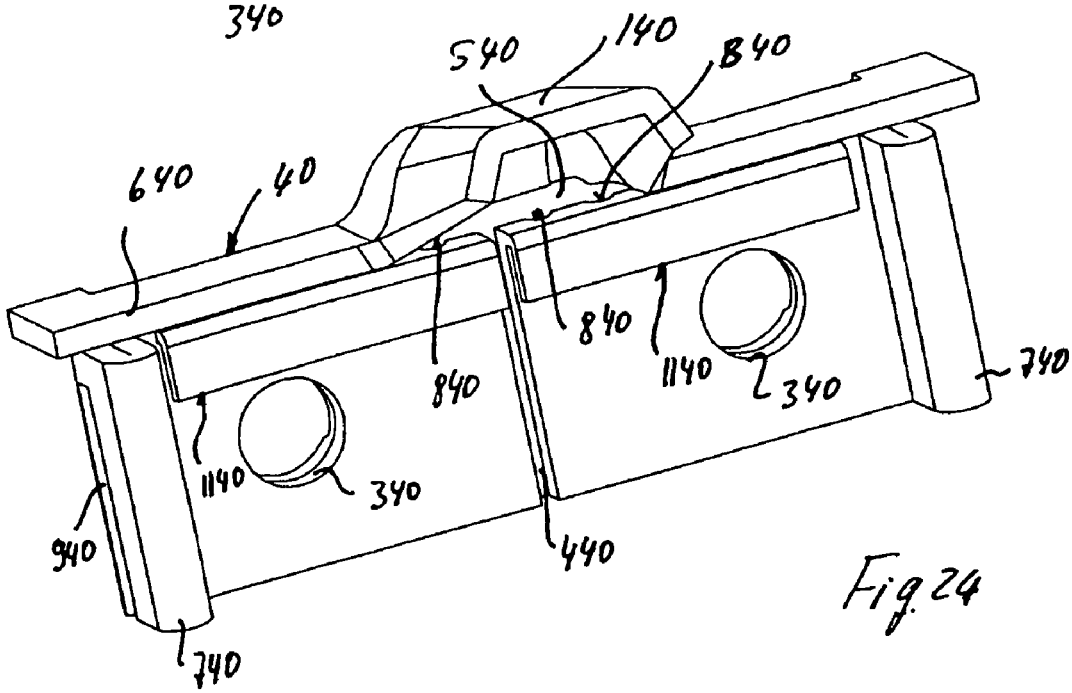
Figure 25:
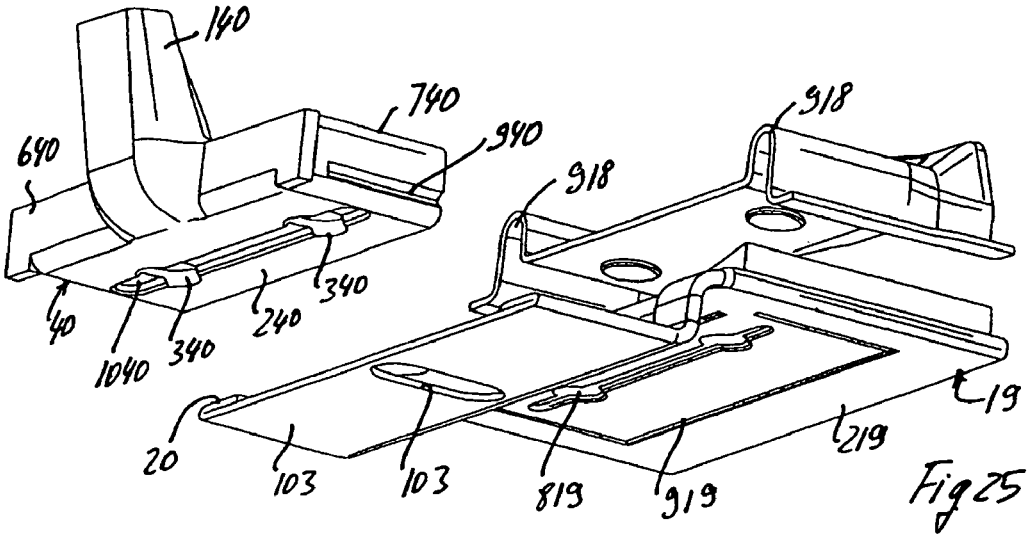
FIGS. 25 to 28 are perspective views of the end section of the burner as shown in FIGS. 14 to 24 associated to the flame arc forming head, in the different steps for connection of said flame arc forming head to the burner.
Figure 26:
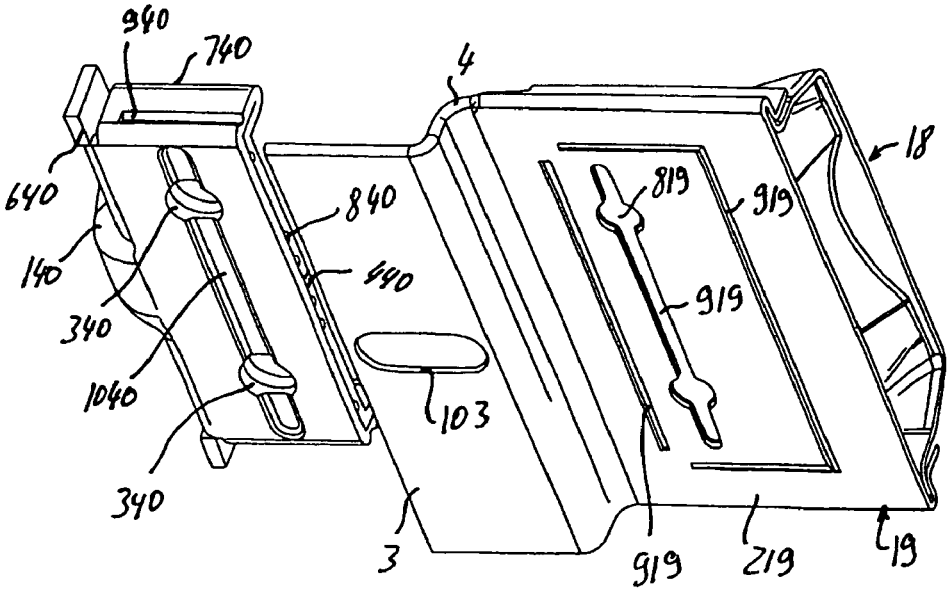

FIGS. 19 to 21 show a flame arc forming head 40 mounted and secured in the corresponding end of the burner body. In order to ensure that the flame arc forming head is fitted in the proper position in the burner, while providing a certain preventive retention force, as is apparent in FIGS. 25 to 28, the end of the burner may be pre-shaped to correspond to the transverse section of the flame arc forming head from the edge through which it is inserted in the end of the burner substantially to the step 1140. This is obtained by keeping a flat shape of the end of the half shell 19 adherent to the face of the flame arc forming head opposite to the stack, and by profiling the end of the opposite half shell 19 which adheres against the face of the flame arc forming head turned toward the stack 140 so that it is complementary to the cross section of the flame arc forming head, i.e. so as to form a slot for insertion of the flattened portion which is delimited at its sides by two grooves for insertion of the flanks 740.

Figure 27:
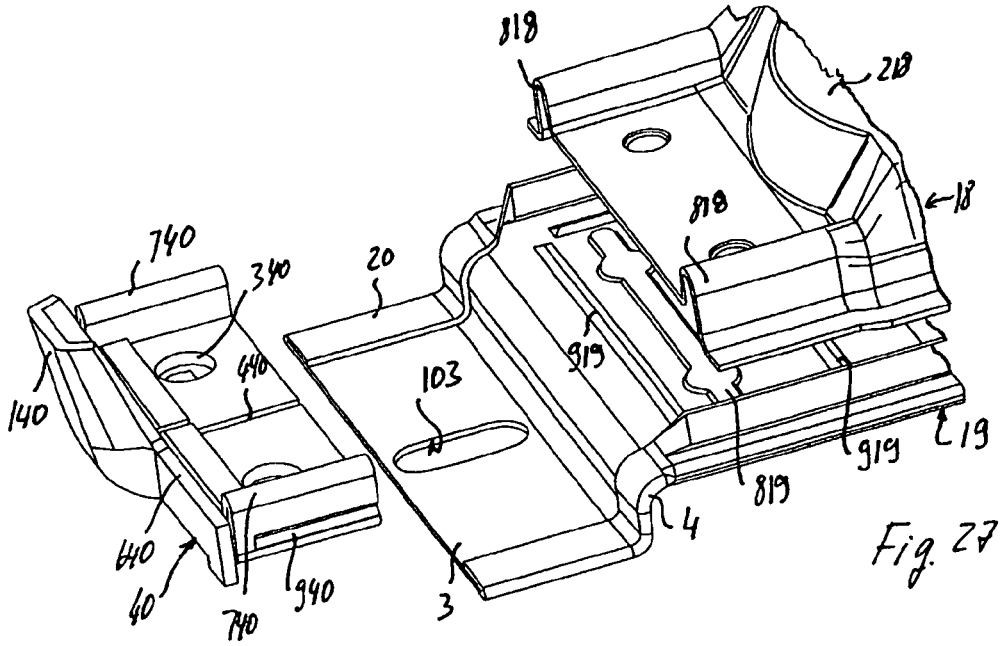
Figure 28:
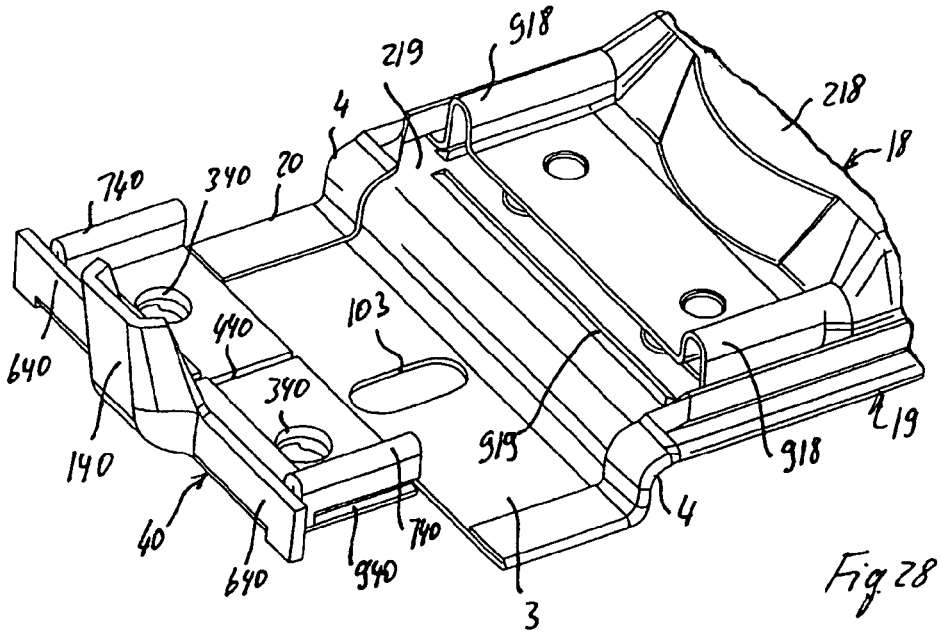

As particularly shown in FIG. 27, the surface of the half shell 19 which is designed to adhere against the face of the flattened portion 240 of the flame arc forming head opposite to the ignition tube has a ridge 819 that is shaped corresponding to the recesses or to the holes 340 and to the transverse recess 1140. Similarly, the opposite wall of the half shell 18 has two ridges 818 coinciding with the holes 340.

One of the two half shells 18, 19 or both further have ribs 919 which delimit the portion in contact with the face of the flame arc forming head which is designed to rest thereon, all this for a better positioning and sealing effect during the fastening process, by a molding process, such as stamping.

Finally, FIGS. 28 to 31 show a variant embodiment of the mounting for the flame detector and/or the igniter. Although this variant is shown in combination with the burner embodiment of FIGS. 14 to 28, it can be also provided in combination with any embodiment described and illustrated above, only a few minor changes being required for full adaptation.

Figure 29:
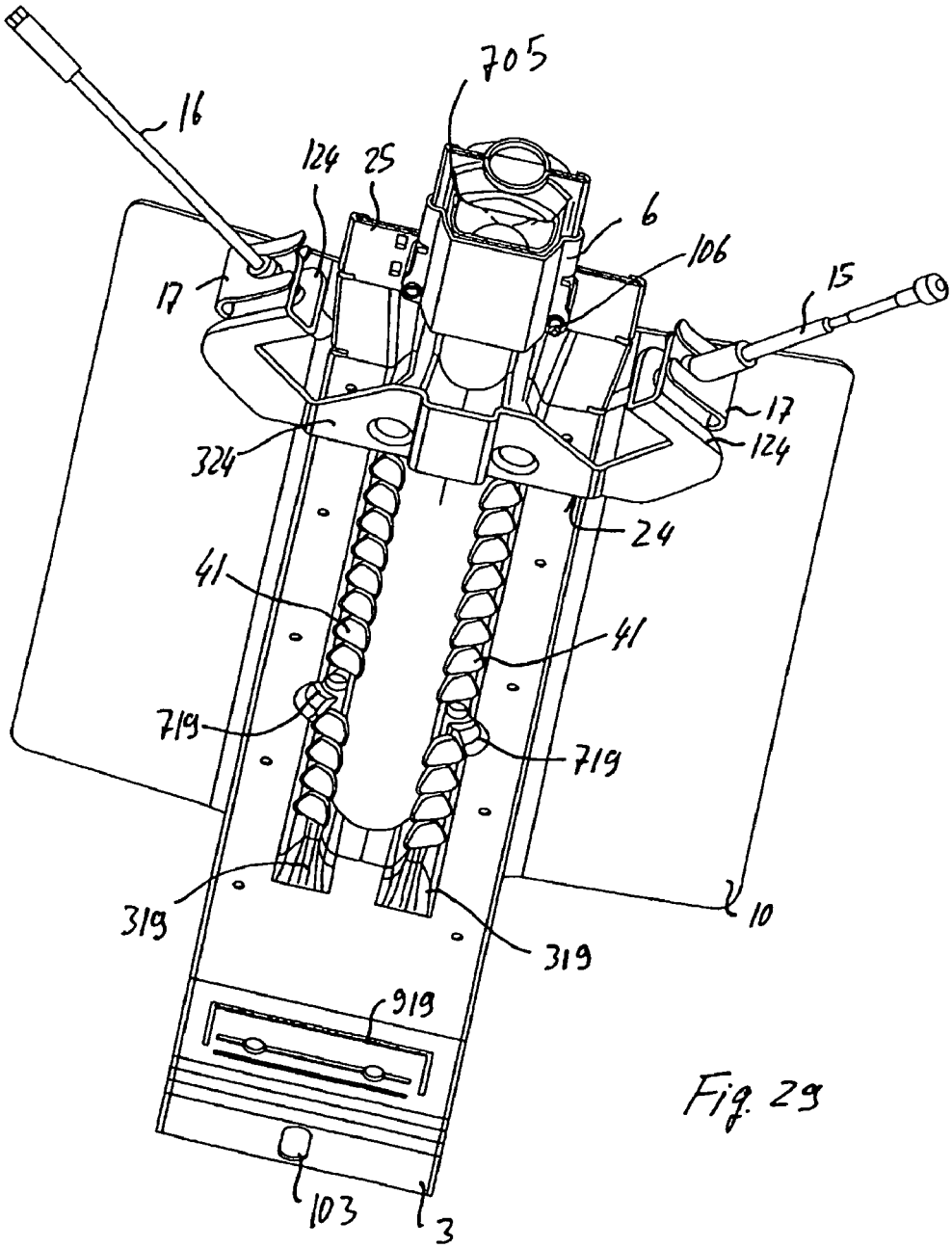
FIG. 29 shows a further variant embodiment of the mounting for the igniter and/or flame detector, applied to the burner as shown in FIGS. 13 to 28.
Figure 30:
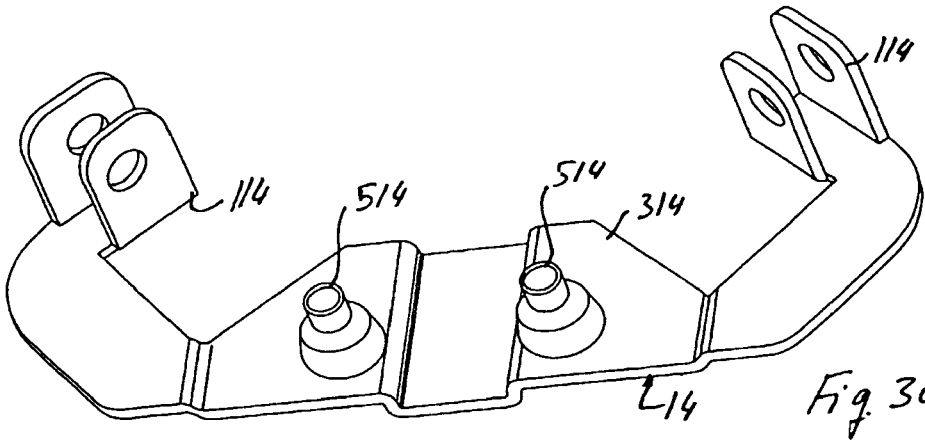
FIG. 30 is a perspective view of the mounting as shown in FIG. 29.
Figure 31:
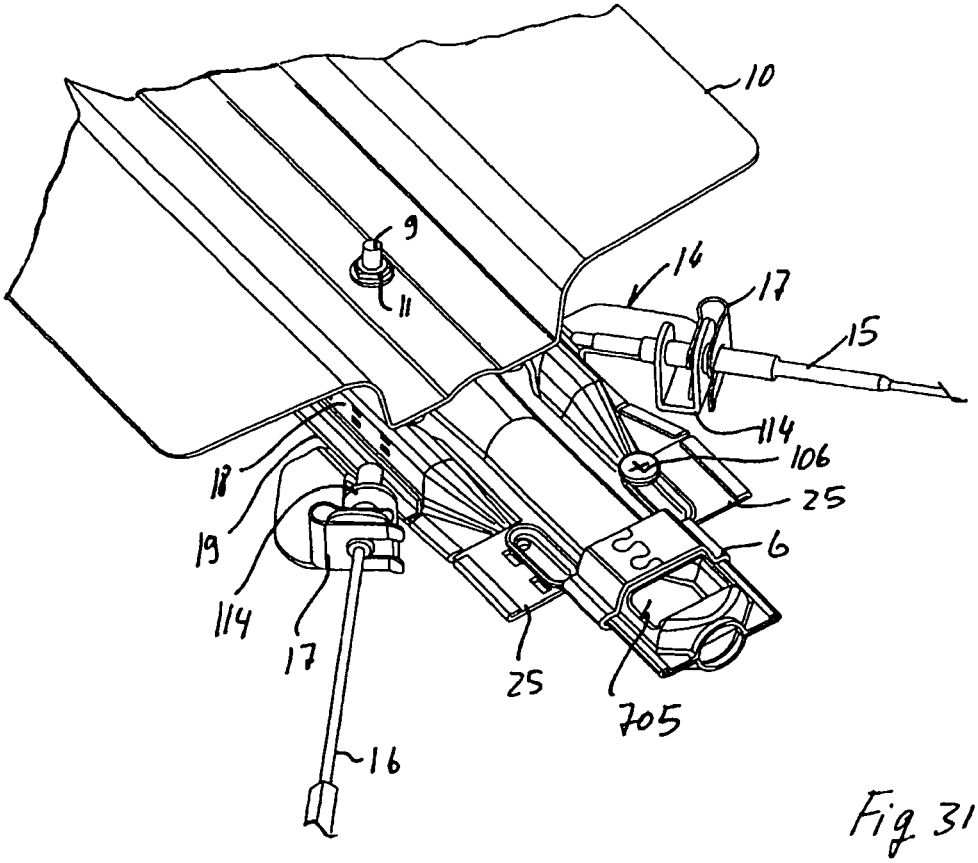
FIG. 31 shows a perspective top view of the burner, an enlarged detail of the burner end which carries the mounting for the flame detector and the igniter.
Figure 32:
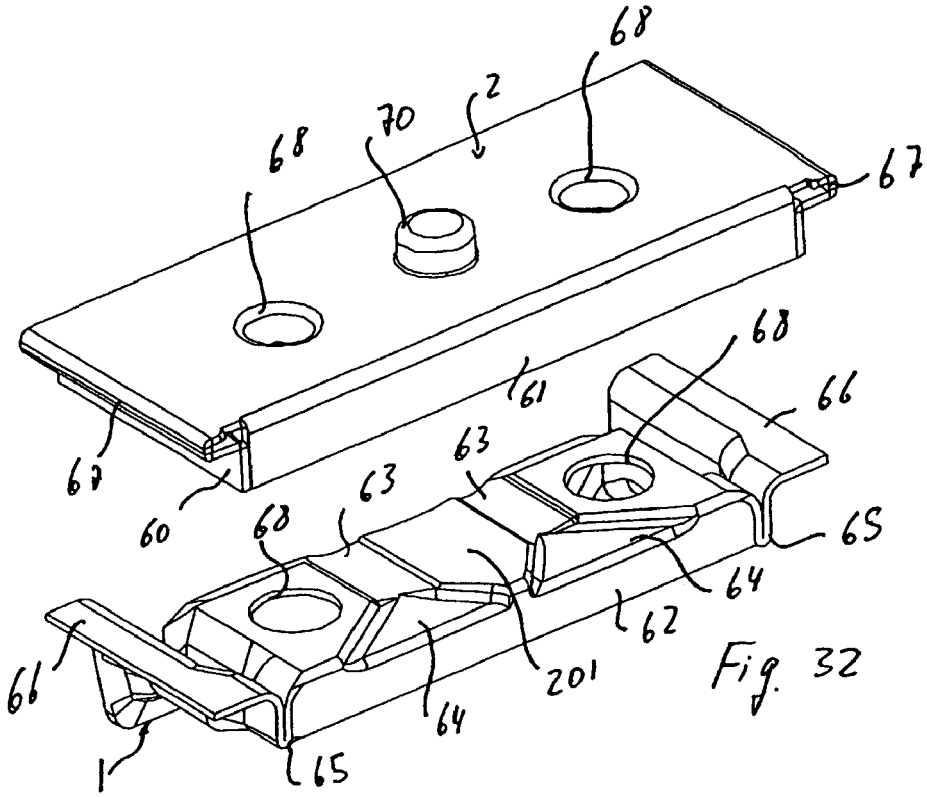
FIGS. 32 to 43 show further different variant embodiments of the burner as shown in the previous figures.
Figure 33:
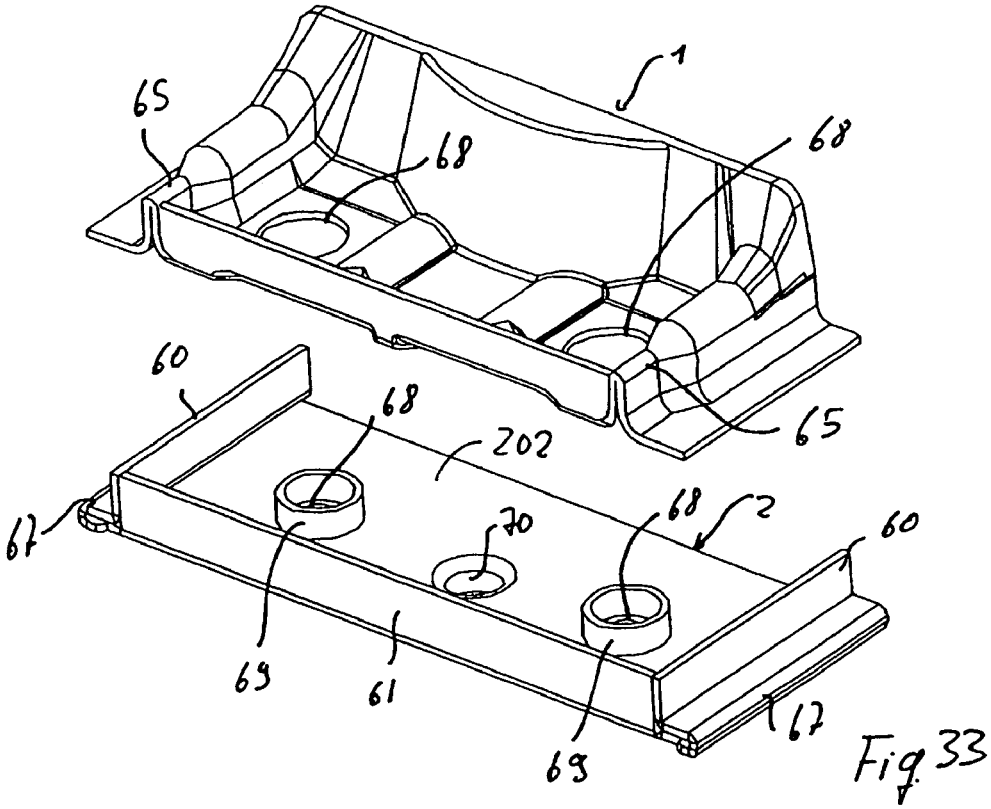
Figure 34:
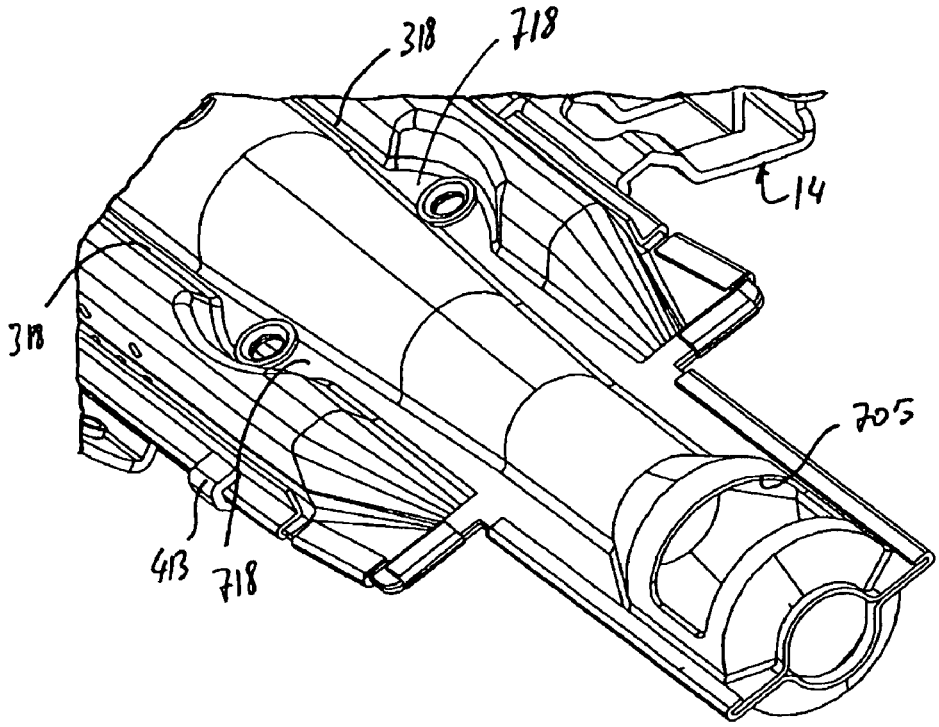
Figure 35:
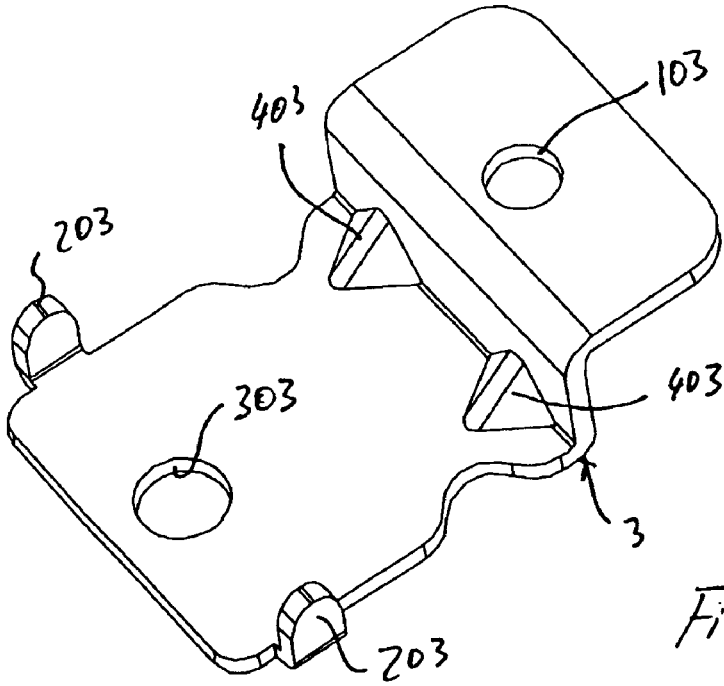

FIGS. 29 to 31 show a mounting whose concept is substantially identical to that of the embodiment of FIG. 1 to 4.

The mounting has two inclined arms 114 which protrude sideways from opposite sides of the burner body and support the igniter and the flame detector respectively. The two arms are connected to each other by an intermediate portion to be fastened to the burner. This part 314 may be secured to the burner as shown, for instance, in FIGS. 1 to 4. Alternatively, in the configuration of FIGS. 14 to 28, fastening is provided by the intermediate crimping sections between the two half shells at the mutual contact portions of the two recesses 318 and 319. Through holes may be provided in these crimping areas, for the passage of fastening bolts 514, attached to the intermediate portion 314 of the mounting 34. The bolts may be threaded, and the mounting may be fastened by tightening nuts and worms or the ends of the bolts projecting from the holes on the face of the burner opposite to the holder may be riveted or otherwise widened. The advantage of providing the flame detector on one side of the burner and the igniter on the opposite side consists in that, if the flame detector detects the flame, ignition must have taken place along the whole perimeter of the burner.

FIGS. 32 to 43 show a further different variant embodiment of the inventive burner. In this embodiment a flame arc forming head is obtained by molding a truncated end of the two half-shells 1 and 2. The flame arc forming head has a shape that substantially resembles that of FIGS. 21 to 29, except that it is not provided as a separate element to be fitted to the end of the burner.

Particularly, the end of the lower half shell 2 is shaped in such a manner as to form a drawer-like head which has vertical tabs 60 and 61 perpendicular to the bottom 202 of the half-shell 2. The corresponding end of the upper half shell 1 is thinned against the bottom of the end of the lower half shell 2 with the flame arc forming head and is shaped in such a manner as to have an end tab 62, which is designed to be disposed parallel to the end tab 61 of the end of the lower half shell 2 with the flame arc forming head. The side 201 adhering against the bottom 202 of the end of the lower half shell 2 with the flame arc forming head is shaped in such a manner as to form two axial grooves 63 which extend symmetrically with respect to the median longitudinal axis and communicate on one side with the inside of the burner, and open out on the other side to the outer side of the tab 62 with two funnel-shaped widened parts 64 during the molding deformation, the upper half shell being shaped in such a manner as to form two lateral longitudinal folds 65 which progressively narrow and are sealably secured in such a manner as to straddle the side tabs of the end of the lower half shell 2 with the flame arc forming head, particularly for a portion of the overall length thereof and especially for an end portion.

The upper half shell 1 is also fitted into the flame arc forming head at the relevant end of the lower half shell 2, even by means of two side tabs 66 which are bent around corresponding side tabs 67 of the end of the lower half shell 2 with the flame arc forming head.

Moreover, in coincident positions, staggered with respect to the axial grooves 63 and to the funnel-shaped end widened portions 64, the adhering bottom sides 201 and 202 of the upper and lower half shells 1 and 2 have two coincident holes 68. The holes formed in the bottom wall 202 of the lower half shell 2 extend toward the bottom wall of the upper half shell 1 by two that have external diameters longer than those of the holes 68 formed in the bottom wall 201 of the upper half shell 1 and that are riveted, during the molding step, against said side 201 to generate further mutual fastening areas of the two flame arc forming head ends of the two half shells 1 and 2.

Thanks to this construction, gas may infiltrate between the end tab 61 of the lower half shell 2 and the end tab 62 of the upper half shell through the grooves 63, 63 and hence, the flame propagates around the end of the burner.

Although the opposite end of the burner may be as provided in one or more of the embodiments as shown in the previous FIGS. 1 to 31, the embodiment as shown in FIGS. 32 to 43 provides that the venturi tube is shaped directly on the half shells, for instance upon their mutual fastening deformation or in a previous step, substantially like on the embodiments as shown in FIGS. 5 to 7, 12, 14 to 19 and 29 and 31.

A variation with respect to these previous arrangements consists in avoiding the presence of the sleeve 6 for adjusting the air/gas ratio controlling aperture 705. Here, adjustment is performed upstream in another manner which is known in the art. Therefore, the aperture 705 is unchanged. An advantage of this embodiment consists in the removal of all slidable supports and position locks of the sleeve 6 and, as a result in the further shortening of the burner.

It shall be further noted that the burner of the variant embodiments of FIGS. 32 to 43 may have shells shaped according to one or more of the previous embodiments.

The construction of the flame arc forming head end according to the embodiment of FIGS. 32 to 43 provides a separate, inexpensive and easily securable fastening base 3 and ignition tube element 12.

The fastening base 3 is particularly formed by an angled plate having two ends on two different planes, connected by a cross member. One of these two ends has a fastening hole 103, whereas the other has two lateral perpendicular tabs 203, separated by the same distance as the holes 68 of the burner end with the flame arc forming head, and designed to be engaged in these holes, their length being such as to allow folding thereof against the wall that surrounds the holes on the side opposite to that in contact with the plate. Particularly, the plate lies over the outer side of the bottom wall 202 of the lower half shell 2, whereas the tabs 203 are riveted against the outer side of the bottom wall of the upper half shell 1. Moreover, in order to increase fastening stiffness, the plate adhering against the bottom side 202 of the lower half shell 2 has a hole 303 whereas, coincident with the latter, said bottom side 202 of the flame arc forming head end of the lower half shell 2 has a bushing 70 with a diameter smaller than the hole 303 and which is designed to be riveted against the edge of said hole on the side opposite to that adhering to the lower half shell 2. In order to provide further stiffness, the base 3 has two troughs 403, in the portion connected to the transverse wall, which troughs are formed by molding, like the rest of the base 3. This embodiment advantageously provides fastening bases of different sizes, in an easy and inexpensive manner, and without having to keep many parts in stock.

Figure 36:
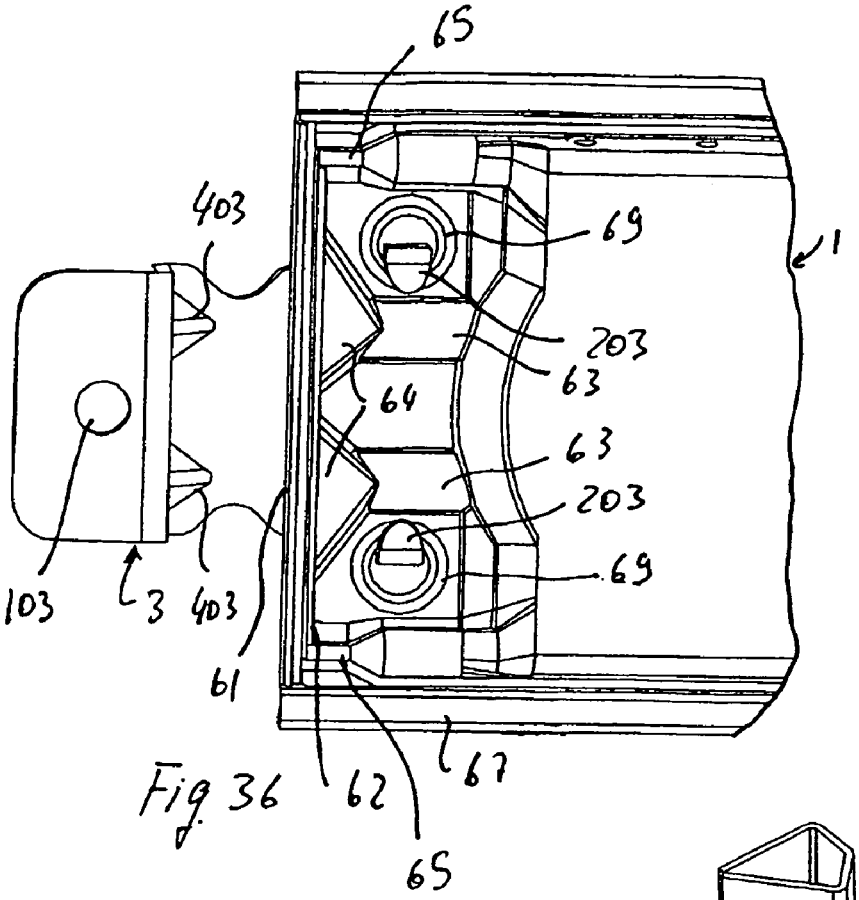

FIG. 36 shows the base 3 fitted on the burner end with the flame arc forming head.

Figure 38:
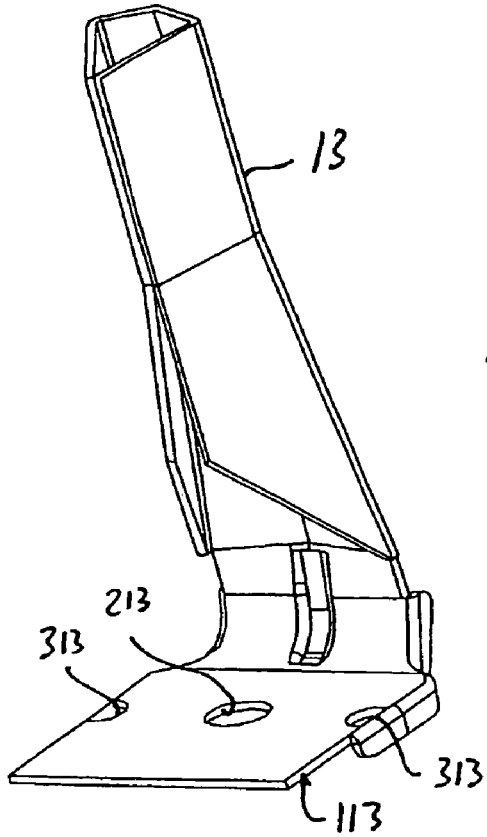
Figure 39:
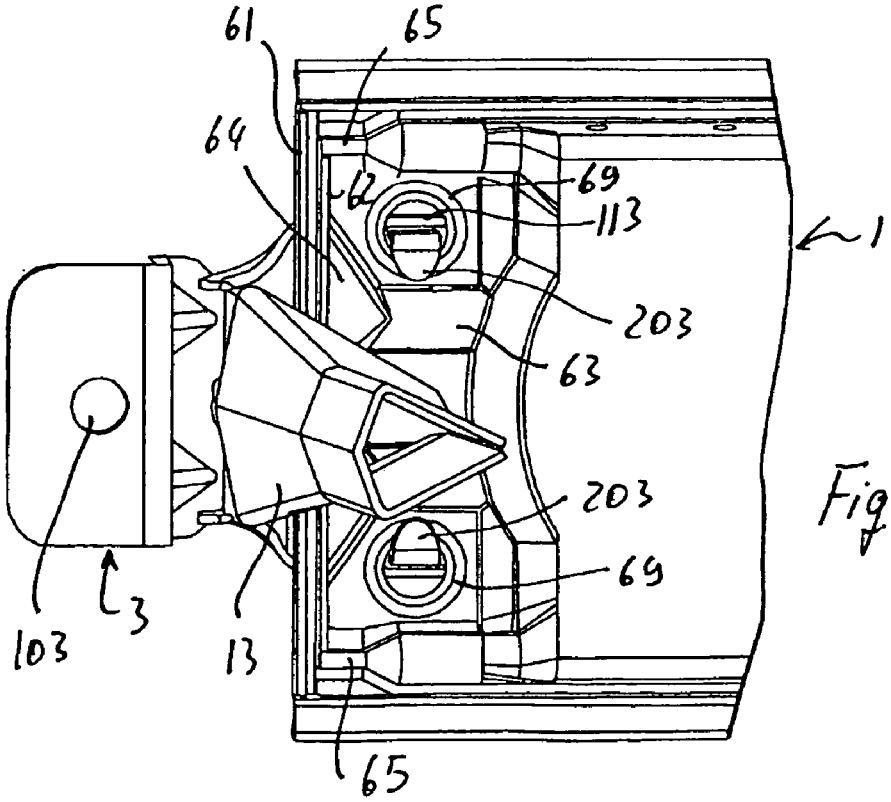
Figure 40:
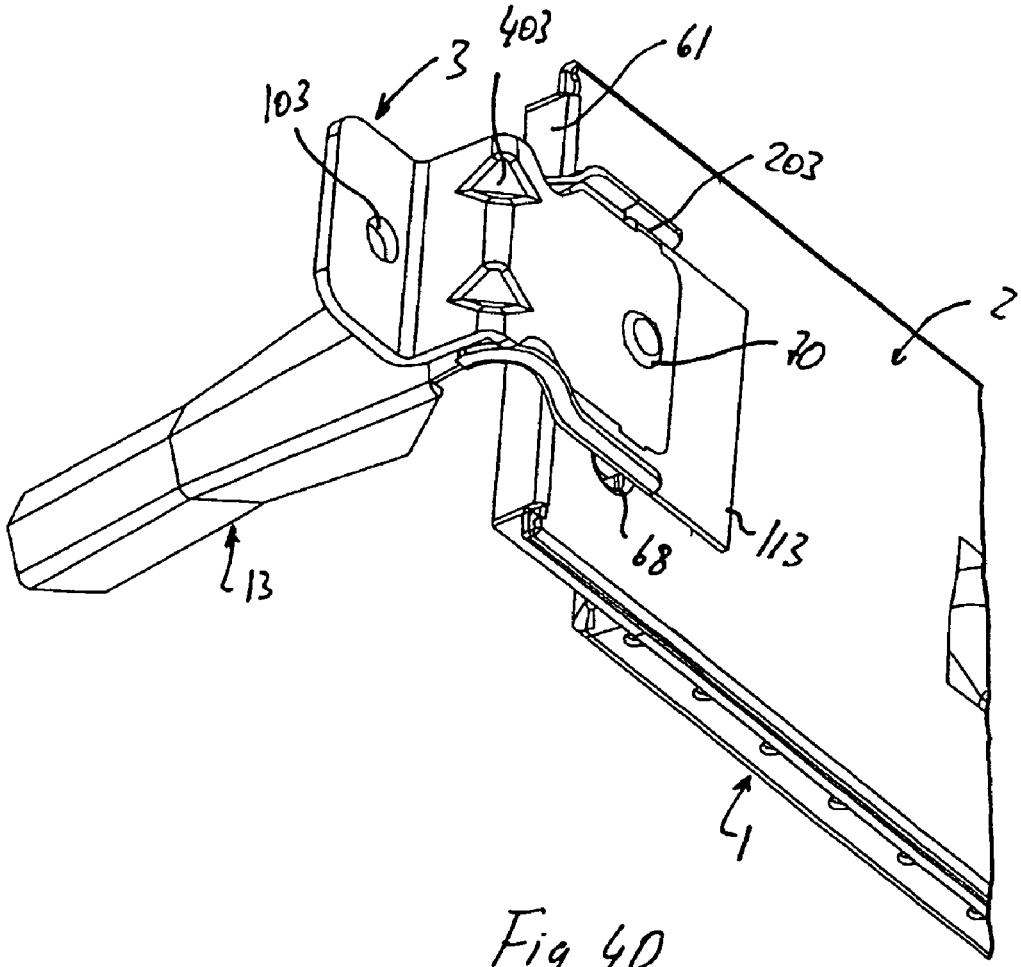

FIG. 38 shows an ignition tube 13 which is fitted onto the burner in the same manner as the base 3. Nevertheless, since the ignition tube is always provided in combination with the base 3, the latter has an angled extension 113 for fastening thereof to the outer side of the bottom 202 of the lower half shell, a hole 213 coincident with the hole 303 of the base 3, having such a diameter as to allow it to be fitted on the bushing 70 projecting from the bottom 202 of the lower half shell 2 and two side apertures 313 coincident with the tabs 203 of the base 3, hence with the holes 68 in the burner end. As shown in FIGS. 39 and 40, here the plate 113 for fastening the ignition tube 13 is interposed between the base 3 and the burner, the tabs 203 of the base 3 and the bushing 70 of the lower half shell 2 being so long as to project out of the corresponding holes 313, 68 and 213, 303 to such an extent as to have a sufficient projecting portion to be riveted and ensure securing thereof.

Figure 37:
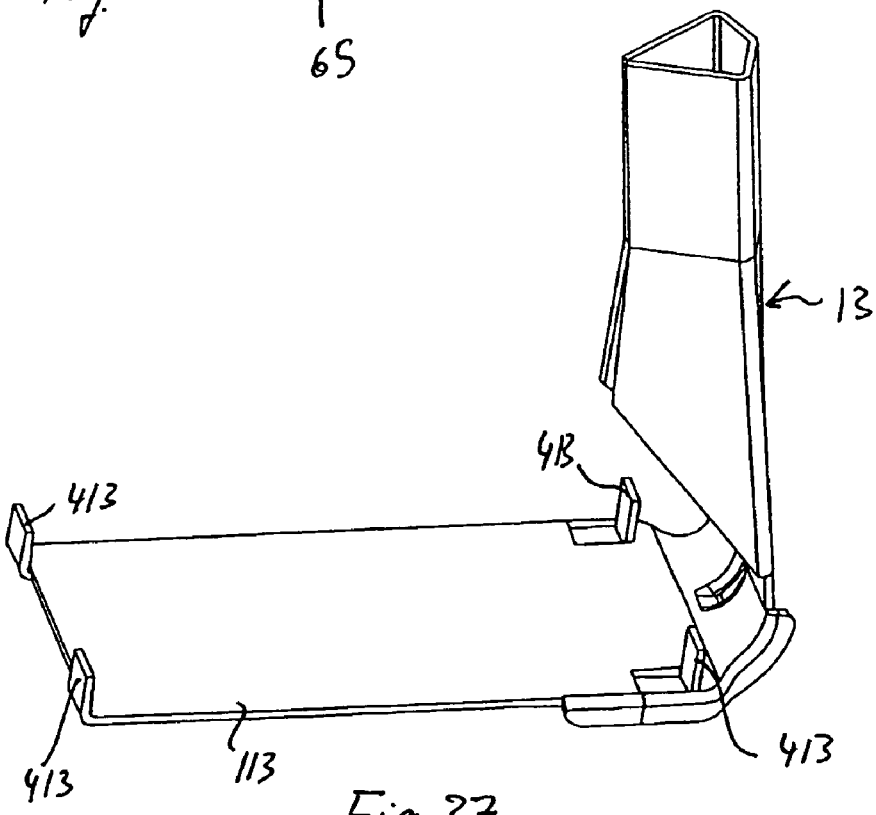
Figure 41:
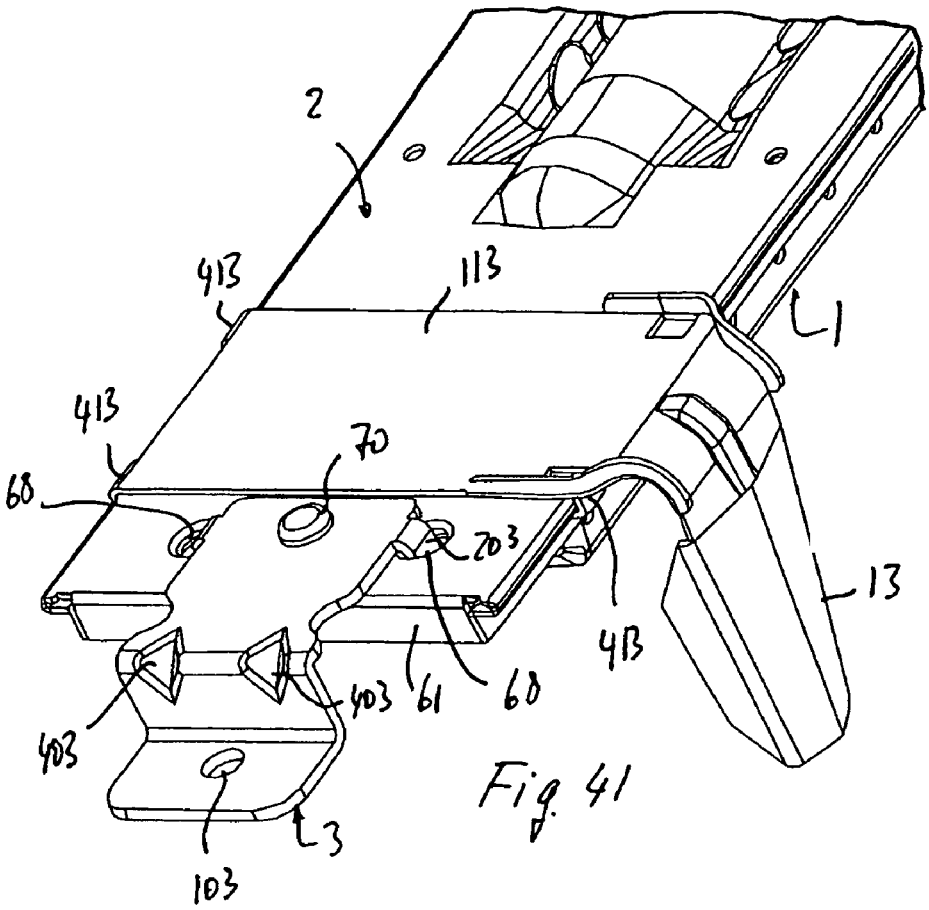
Figure 42:
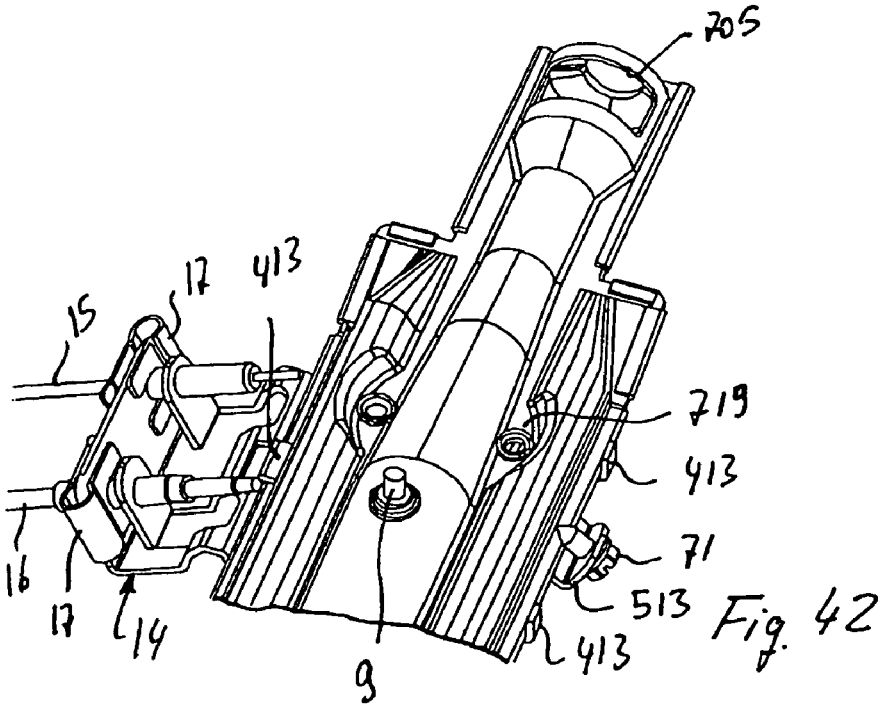

FIG. 37 shows a variant of the ignition tube 13 which allows the latter to be fitted to the burner not at the end with the flame arc forming head, but in a side position and more particularly in any side position. In this case, the fastening plate 113 of the ignition tube 13 is as long as the bottom 202 of the lower half shell 2 and has, coincident with each of the two ends of said plate 313, a pair of fastening tabs 413 which are designed to be folded or riveted against the side edge of the burner, as shown in FIG. 41, which side edge has the form of a side flange, at least at the end with the flame arc forming head. Another fastening point may be provided in an intermediate portion of the burner, where the side flanges form a side groove of the burner, by providing tabs 413 of an appropriate length.

The above description shows that the burner of this embodiment can be fabricated according to different designs, in a fast, easy and inexpensive manner, so as to avoid the need to keep many parts in stock, thanks to this fast fabrication.

Figure 43:
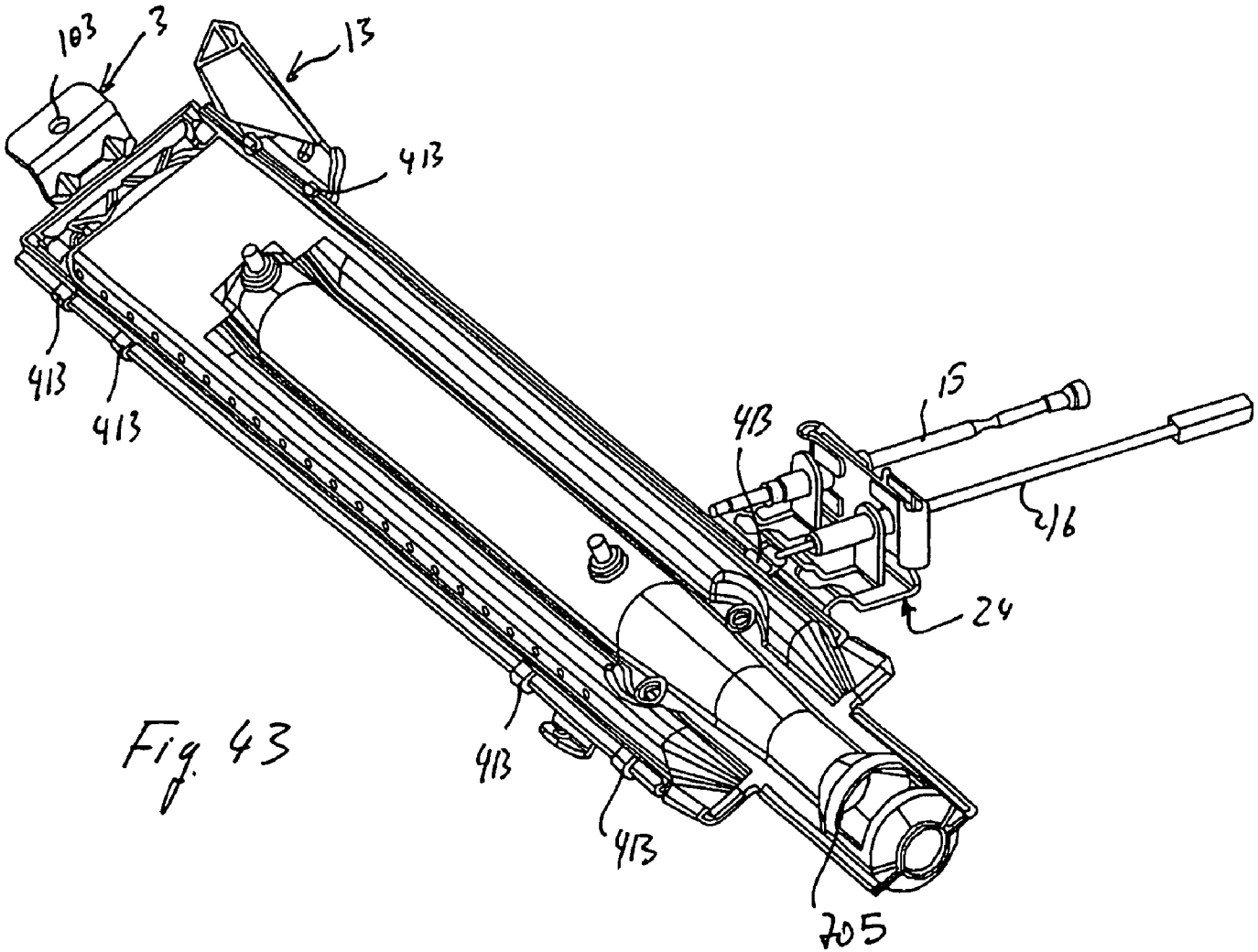

The embodiment of the ignition tube as shown in FIG. 40 may be easily and advantageously extended to the means for securing the mounting 14 for supporting the flame detector and/or the ignition electrode. Here, this mounting has a fastening plate identical to the plate 313 of the ignition tube, whereas the tabs 413 may assist fastening like the ignition tube 13 of FIGS. 37 and 41, as shown in FIG. 43. However, in the embodiment of FIG. 42, these tabs only have a lateral containment function, so as to form a sort of saddle. At the end whereat the fastening plate 313 is connected to the mounting 14, the tabs or an appropriate shaping of the connection area form a trough or a C shape in which the side peripheral flange of the corresponding side of the burner slidably engages, in such a manner as to only allow the plate 313 to slide in the burner's longitudinal direction. Conversely, the tabs 413 at the opposite free end only overlap laterally the corresponding side flange of the burner, whereas the plate is locked perpendicular to said flange, i.e. against disengagement thereof from the tabs, thanks to removable means, such as a fastening screw 71 which is engaged in an extension 513 of the fastening plate and has an inclined orientation in such a manner as retain the side peripheral flange of the burner not only along the side edge, but also along the side thereof opposite to the fastening plate 113, whereby said plate 113 is hooked and secured in stable and removable manner to the burner.

Obviously, the invention is not limited to the embodiments described and illustrated herein but may be greatly varied, especially as regards construction. For instance, the venturi tube may be provided on the same axis with the tubular body, and the opposite end may be closed by compression. Alternatively, the venturi tube may be provided in an offline position and the two opposite ends of the tubular body may be closed by compression. All this without departure from the guiding principle disclosed above and claimed below.

The invention claimed is:

1. A burner comprising:

a tubular body comprising a first half shell and a second half shell coupled one to one other; and a venturi tube coupled to a first end of the tubular body, wherein the first and the second half shells each comprise a substantially flat central portion extending longitudinally and first and second lateral portions extending angularly therefrom, the first and the second half shells being coupled to one another by coupling the first and the second lateral portions to one another, wherein a plurality of longitudinal depressions project inwardly from the flat central portions of the first and the second shells to direct an air and gas mixture within the tubular body along longitudinal channels defined by the inward projecting longitudinal depressions, wherein the longitudinal depressions extend substantially parallel to a longitudinal axis along a portion of the tubular body and converge inwardly to form a funnel shape in the proximity of the venturi tube, and wherein the first half shell comprises a plurality of opening rows extending longitudinally to enable the air and gas mixture to egress the openings in the rows to feed a flame, one of the opening rows comprising a plurality of openings having a smaller size than the openings in the other opening rows such to provide a pilot burner.

2. The burner as claimed in claim 1, further comprising a flame arc forming head coupled to a second end of the tubular body, wherein the flame arc forming head comprises a lateral flange substantially having a same profile as a profile of the coupled first and the second lateral portions, such to provide substantial profile continuity between the lateral flange and a profile or a coupling area between the first and second lateral portions, and wherein the venturi tube is integral with the first and the second half shells and is provided by a corrugated portion of the first shell and a corrugated portion of the second shell coupled to one another.

3. The burner as claimed in claim 2, further comprising a tubular sleeve slidable over an opening in the venturi tube, the opening in the venturi tube providing ingress of air or gas into the venturi tube, a sliding movement of the tubular sleeve controlling the ingress of the air or gas into the venturi tube.

4. The burner as claimed in claim 2, wherein the flame arc forming head comprises an inner arched wall member directing the air and gas mixture to pilot burner openings disposed in a wall of the flame arc forming head, and wherein the pilot burner openings face the lateral flange at a distance therefrom.

5. The burner as claimed in claim 4, further comprising a duct extending outwardly from the flame arc forming head.

6. The burner as claimed in claim 5, wherein the duct has a U-shaped profile.

7. The burner as claimed in claim 5, wherein at least a portion of the flame arc forming head is force fit within the second end of the tubular body.

8. The burner as claimed in claim 7, wherein the flame arc forming head is further secured to the second end of the tubular body by coupling an end of a bushing projecting inwardly within the flame arc forming head with a boss protruding inwardly from the first or the second half shell.

9. The burner as claimed in claim 7, further comprising one or more tabs extending from the first or the second forming head, the one or more tabs preventing a longitudinal movement of the flame arc forming head.

10. The burner as claimed in claim 1, wherein the first and the second lateral portions of the first and the second half shells each comprise a flange extending therefrom, wherein the flanges extending from the lateral portions of the second half shell are wider than the flanges extending from the lateral portions of the first half shell, wherein the first and the second lateral portions are coupled by laterally juxtaposing the flanges of the first and second half shells and by wrapping a portion of the flanges of the second half shell over the flanges of the first half shell to form a tight seal, wherein the mated flanges provide a U-shaped profile defined by a wall of the tubular body and the mated flanges, and wherein the openings having the smaller size are disposed within the U-shaped profile.

11. The burner as claimed in claim 1, wherein the second half shell extends longitudinally beyond the first half shell to provide an extension from the tubular body configured for connecting the tubular body to a supporting structure.

12. The burner as claimed in claim 11, wherein the extension comprises one or more stiffened edges.

13. The burner as claimed in claim 12, wherein the stiffened edges are formed by rolling over lateral portions of the extension.

14. The burner as claimed in claim 12, wherein the extension has a Z profile comprising two end portions substantially parallel to a longitudinal axis of the tubular body and a lateral portion therebetween.

15. The burner as claimed in claim 1, wherein the opening rows comprise two upper opening rows having a larger size and a lower opening row having the smaller size.

16. The burner as claimed in claim 1, wherein the longitudinal depressions impressed in the first shell are essentially V-shaped.

17. The burner as claimed in claim 1, wherein the apices of a first longitudinal depression in the first shell and of a second longitudinal depression in the second shell are longitudinally aligned.

18. The burner as claimed in claim 1, further comprising a parabolic reflector coupled to the first or second half shell.

19. The burner of claim 18, wherein the parabolic reflector comprises a central portion coupled to the first or the second half shell, symmetrical lateral extensions protruding outwardly, and connecting portions extending upwardly and coupling the central portion to the symmetrical lateral extensions.

20. The burner as claimed in claim 18, wherein the parabolic reflector is removably coupled to the first or the second half shell.

21. The burner as claimed in claim 1, further comprising an igniter and a thermocouple coupled to the tubular body.

22. The burner as claimed in claim 21, wherein the igniter and the thermocouple are removably coupled to the tubular body in the proximity of the venturi tube.

23. The burner as claimed in claim 21, wherein the igniter and the thermocouple are disposed angularly in relation to the flow of the air and gas mixture within the tubular body.

24. The burner as claimed in claim 23, wherein the igniter and the thermocouple are disposed at about 135 degrees in relation to the flow of the air and gas mixture within the tubular body.

* * * * *

UNITED STATES PATENT AND TRADEMARK OFFICE

CERTIFICATE OF CORRECTION

PATENT NO. : 7,506,645 B2
APPLICATION NO. : 10/509634
DATED : March 24, 2009
INVENTOR(S) : Giorgio Offredi It is certified that error appears in the above-identified patent and that said Letters Patent is hereby corrected as shown below:

On the title page, item (73):

Assignee should read: --Castfutura S.p.A., Milan (IT)--

Signed and Sealed this

Sixteenth Day of February, 2010

David J. Kappos

David J. Kappos
*Director of the United States Patent and Trademark Office*